US006900365B2

(12) United States Patent
Chen et al.

(10) Patent No.: US 6,900,365 B2
(45) Date of Patent: May 31, 2005

(54) PROCESS FOR CONVERTING HEAVY HYDROCARBON FEEDS TO HIGH OCTANE GASOLINE, BTX AND OTHER VALUABLE AROMATICS

(75) Inventors: Cong-Yan Chen, Kensington, CA (US); Stacey I. Zones, San Francisco, CA (US); Andrew Rainis, Walnut Creek, CA (US); Dennis J. O'Rear, Petaluma, CA (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 285 days.

(21) Appl. No.: 10/011,811

(22) Filed: Dec. 11, 2001

(65) Prior Publication Data

US 2003/0019792 A1 Jan. 30, 2003

Related U.S. Application Data

(63) Continuation-in-part of application No. 09/635,139, filed on Aug. 9, 2000, now abandoned.

(60) Provisional application No. 60/165,454, filed on Nov. 15, 1999.

(51) Int. Cl.[7] ..... C07C 4/18

(52) U.S. Cl. ..... 585/489; 585/483; 585/486; 585/488; 208/133; 208/134; 208/137; 208/138

(58) Field of Search ..... 208/133, 134, 208/135, 136, 137, 138; 585/483, 486, 488, 489

(56) References Cited

U.S. PATENT DOCUMENTS

| | | | |
|---|---|---|---|
| 4,677,240 | A | 6/1987 | Carlson et al. |
| 5,114,565 | A | 5/1992 | Zones et al. |
| 5,328,595 | A | 7/1994 | Rainis |
| 5,391,287 | A | 2/1995 | Nakagawa |
| 5,393,407 | A | 2/1995 | Zones et al. |
| 5,609,751 | A | 3/1997 | Wall |
| 6,080,382 | A | 6/2000 | Lee et al. |
| 6,103,215 | A | 8/2000 | Zones et al. |

*Primary Examiner*—Walter D. Griffin
(74) *Attorney, Agent, or Firm*—Burns, Doane, Swecker & Mathis LLP

(57) ABSTRACT

A catalytic hydrodealkylation/reforming process which comprises contacting a heavy hydrocarbon feedstream under catalytic hydrodealkylation/reforming conditions with a composition comprising borosilicate molecular sieves having a pore size greater than about 5.0 Angstroms and a Constraint Index smaller than about 1.0; further containing a hydrogenation/dehydrogenation component; wherein at least a portion of the heavy hydrocarbon feedstream is converted to a product comprising benzene, toluene, xylenes and ethylbenzene.

33 Claims, 4 Drawing Sheets

New Routes for Use of FCC Products

Option #1

New Routes for Use of FCC Products

Option #2

New Routes for Use of FCC Products

Option #3

PROCESS FOR CONVERTING HEAVY HYDROCARBON FEEDS TO HIGH OCTANE GASOLINE, BTX AND OTHER VALUABLE AROMATICS

CROSS-REFERENCE TO RELATED APPLICATIONS

This application is a continuation-in-part of, and claims priority from, U.S. patent application No. 09/635,139, filed Aug. 9, 2000, now abandoned, which claims the benefit of U.S. Provisional Application No. 60/165,454, filed Nov. 15, 1999, the contents of both prior applications being incorporated herein by reference.

FIELD OF THE INVENTION

The present invention relates to a process for converting heavy hydrocarbon feeds to high octane gasoline, BTX and other valuable aromatics using microporous, crystalline borosilicate molecular sieve based catalysts.

BACKGROUND OF THE INVENTION

Heavy petroleum streams, such as fractions of jet fuels, Fischer-Tropsch ("FT") synthesis products, and FCC Light Cycle Oil ("LCO"), have a relatively low value. It would be very useful to find an economical way to upgrade such heavy streams.

Catalytic hydrodealkylation/reforming using microporous, crystalline borosilicate molecular sieve based catalysts is a one-stage process for upgrading a heavy petroleum feed to more useful product(s) such as high octane gasoline and aromatics. The aromatics thus produced, such as BTX (benzene, toluene, xylenes), EB (ethylbenzene), naphthalene and alkylnaphthalenes (methylnaphthalenes, dimethylnaphthalenes, etc.), are valuable feedstreams for various chemical processes. In the one-stage hydrodealkylation/reforming process, the heavy hydrocarbons such as heavy alkylaromatic compounds are converted via the hydrodealkylation to lighter and useful components which form the aforesaid useful aromatics under the reforming conditions.

The conventional amorphous reforming catalysts, such as Pt—Re/$Al_2O_3$/Cl which is associated with a small amount of chloride as promoter of acidity, do not fulfill efficiently the aforesaid task, especially due to the catalyst deactivation which occurs when the feed is a heavy feed such as fractions of jet fuels, FT synthesis products, and LCO.

In attempts to develop environmentally benign reforming catalysts, it was discovered that Pt supported on K-exchanged zeolite L (Pt/K—L) and its derivatives such as Pt/BaK—L exhibit exceptional selectivity for the aromatization of n-hexane, as described in U.S. Pat. Nos. 4,104,320; 4,434,311; 4,447,316; 5,914,028. In addition, other investigators have found methods of using other zeolites such as mordenite, ZSM-5/–11 and silicalite as catalysts for various reforming processes. The use of these zeolite catalysts and processes are described, for example, in U.S. Pat. Nos. 3,546,102; 3,574,092; 3,679,575; 4,018,711; 4,347,394. However, all these zeolites including zeolite L (zeolites are defined as microporous, crystalline aluminosilicates) fail in reforming the heavy feeds such as fractions of jet fuels, FT synthesis products, FCC heavy gasoline and LCO. This is at least partially because of the catalyst instability with these heavy feeds and the sulfur intolerance of the catalysts.

Catalytic hydrocracking or hydrodealkylation over zeolite (aluminosilicate) based or amorphous catalysts is another way to upgrade heavy hydrocarbon feeds by converting them to high octane gasoline and BTX, as described in U.S. Pat. Nos. 4,919,789; 4,943,366; 5,001,296; 5,043,513; 5,219,814; 5,401,389; 6,037,302; 6,114,268; 6,133,494. When compared to the catalytic hydrodealkylation/reforming process of the present invention, however, the hydrocracking/hydrodealkylation approach has at least three drawbacks. These drawbacks include: (1) some of the resulting non-aromatic products of hydrocracking/ hydrodealkylation are not further reconstructed or reformed to the useful BTX and naphthalene-related compounds because the process lacks in an integrated reforming function; (2) some of the resulting aromatic products are re-hydrogenated to their non-aromatic counterparts under the hydrocracking/ hydrodealkylation conditions; and (3) high hydrogen consumption associated with the hydrocracking/ hydrodealkylation chemistry.

Other investigators have found methods of upgrading the aforesaid heavy hydrocarbons via integrating the hydrocracking/hydrodealkylation and reforming in one process. For example, M. N. Harandi et al. (U.S. Pat. No. 5,409,595) teaches a process for converting $C_9$+ containing heavy naphthas to gasoline products of reduced end boiling range and higher octane than the feed. They claim the process is suitable for making BTX. The process is two-stage. The first is a hydrocracking stage in which heavier components are converted to lighter products. The first stage uses zeolites for the cracking reactions, e.g., beta, ZSM4, ZSM-12, mordenite, etc. In the second stage, at least a portion of the resultant hydrocracking product from the first stage is then aromatized in a reforming section. The reforming uses typical reforming catalysts containing chlorine (HCl) as an acidity promoter. The disadvantages of this process are that it utilizes a two-stage approach and environmentally unfriendly reforming catalysts containing HCl. As mentioned above, the reforming catalyst used in the second stage is typically not capable of handling the heavy feeds. U.S. Pat. No. 5,080,776 (Partridge et al.) also discloses a similar two-stage hydrocracking-reforming process.

L. L. Breckenridge and C. L. Markham (U.S. Pat. No. 4,906,353) claim a process which includes reforming a sulfur, nitrogen and/or olefin containing feed, e.g., an FCC gasoline, using noble metal containing large pore zeolites (aluminosilicates) having Constraint Indexes below 2 and a framework molar $SiO_2/Al_2O_3$ ratio of at least about 50. The given examples of such zeolites are zeolite Beta, zeolite L, faujasite, mordenite, ZSM-3, ZSM-4, ZSM-18 and ZSM-20. The process can reportedly be operated in two modes, namely reforming and hydrocracking, to offer the refiner increased operation flexibility in meeting rapidly fluctuating changes in demand for high octane gasoline and LPG (Liquid Petroleum Gas) products. When compared with the borosilicate molecular sieve based catalysts of our present invention to be described below, the zeolite (aluminosilicate) catalysts applied in the above process (U.S. Pat. No. 4,906,353) contribute favorably to hydrocracking and hydrodealkylation due to the inherent strong acidity of zeolites.

As reported in U.S. Pat. Nos. 4,859,442; 5,106,801; 5,187,132; 5,202,014; 5,215,648; 5,591,322; 5,653,956 (Zones et al.), recently a series of novel microporous, crystalline borosilicate molecular sieves (defined herein as borosilicate molecular sieves to differentiate from zeolites which are microporous, crystalline aluminosilicates) has been successfully synthesized. Examples are SSZ-24, SSZ-25, SSZ-31, SSZ-33, SSZ-35, SSZ-37, SSZ-42, SSZ-43, SSZ-44, SSZ-47, SSZ-48, CIT-5, UTD-1 and/or and low-aluminum boron-beta (B-beta). This class of molecular sieves possesses lower acidity than zeolites (aluminosilicates). When zeolites (aluminosilicates) are used as reforming catalysts, their highly acidic framework is usually neutralized by using alkali and/or alkaline-earth cations in order to reduce the acidity to a very low level with a target of eliminating the undesirable hydrocracking reactions, as demonstrated by Pt/BaK—L. With their lower acidity properties, borosilicate molecular sieves provide a new class of catalyst materials for catalytic reforming. Zones et al. (U.S. Pat. No. 5,114,565, and in *Advanced Catalytic Materials*-1996, edited by P. W. Lednor et al., publisher: Materials Research Society) have already demonstrated that large pore borosilicate molecular sieves are useful catalysts for reforming hydrocarbon feedstreams such as naphtha. In addition, previous work by Klotz (U.S. Pat. No. 4,269,813) has also shown the value of using intermediate pore borosilicate molecular sieves for aromatics processing. Similarly, the use of some borosilicate zeolites having a Constraint Index between 1 and 12 (such as ZSM-5, ZSM-11, ZSM-12, ZSM-23, ZSM-35, ZSM-38, ZSM-48 and zeolite beta) for catalytic reforming and other reactions is described in European Patent Application No. 188,913. It would be beneficial to have a process which employs novel borosilicate molecular sieves as catalysts to provide a new, economical and effective process for upgrading heavy petroleum streams containing larger molecules to high octane gasoline and valuable aromatics. We have found that the use of some novel microporous, crystalline borosilicate molecular sieves provides such a process. Preferred embodiments of the process of the invention are described below.

SUMMARY OF THE INVENTION

According to the present invention, a process is provided for catalytic hydrodealkylation/reforming for converting heavy hydrocarbon feeds having a major portion thereof boiling from about 350° F. to about 800° F. to high octane gasoline, BTX and other valuable aromatics. The process includes contacting a hydrocarbon feedstream under catalytic hydrodealkylation/reforming conditions with a microporous, crystalline borosilicate molecular sieve composition including an SSZ-24, SSZ-25, SSZ-31, SSZ-33, SSZ-35, SSZ-37, SSZ-42, SSZ-43, SSZ-44, SSZ-47, SSZ-48, CIT-5, UTD-1 and/or low-aluminum beta borosilicate molecular sieve catalyst. The products produced include BTX (benzene, toluene, and xylenes), EB (ethylbenzene), naphthalene and alkylnaphthalenes (methylnaphthalenes, dimethylnaphthalenes, etc.).

Among other factors, the present invention is based on our finding that microporous, crystalline borosilicate molecular sieve catalysts have unexpectedly outstanding hydrodealkylation/reforming properties. These include producing clean BTX/EB fractions (i.e., without substantial amount of other hydrocarbons such as paraffins, olefins and/or naphthenes in this cut), high yield of naphthalene and alkylnaphthalenes, high sulfur tolerance, high catalyst stability and activity when heavy hydrocarbon streams are employed as feeds.

DETAILED DESCRIPTION OF THE INVENTION

A. Overview

Figure 1A:
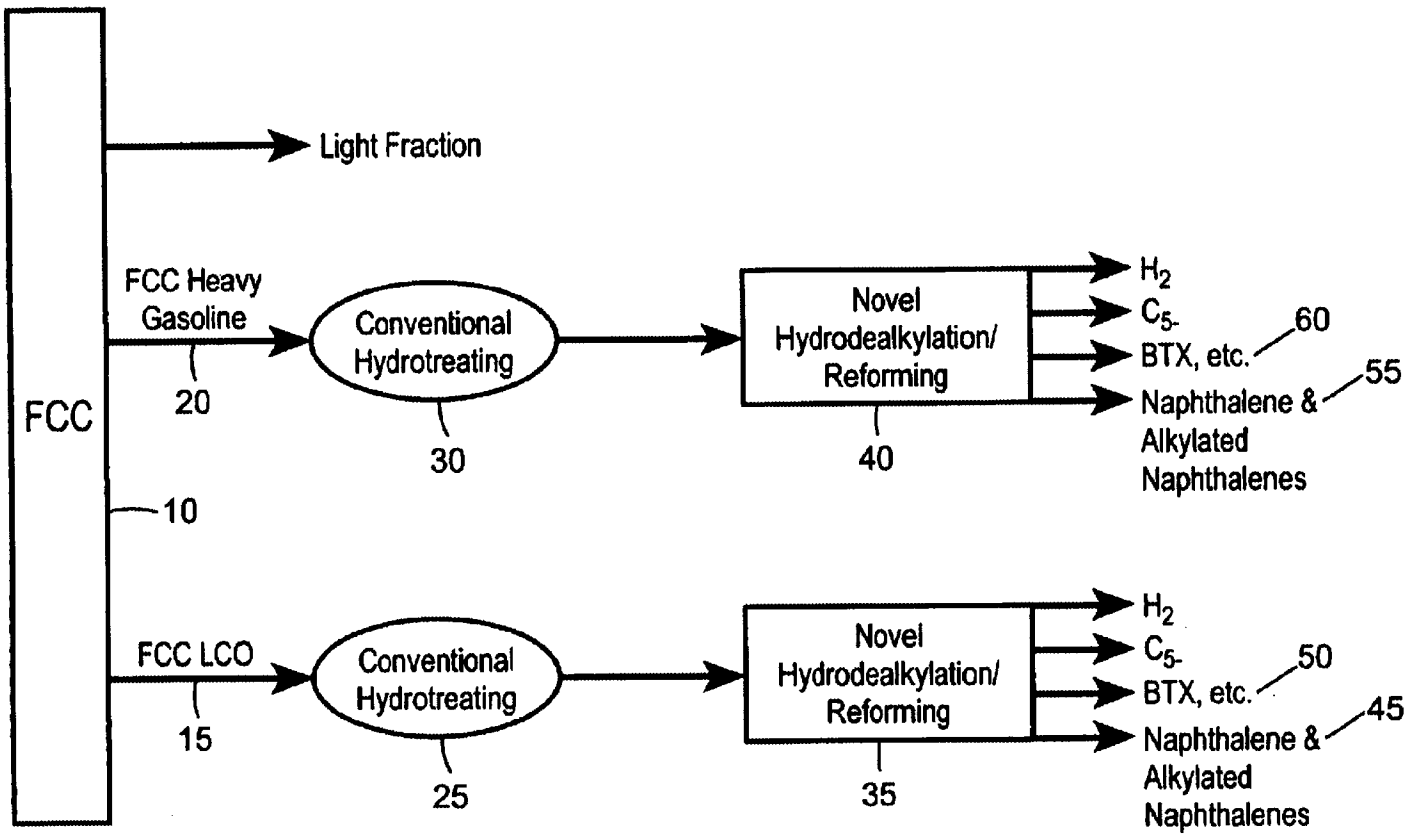
FIGS. 1A, 1B, and 1C depict, in various embodiments, schematic flow charts of the process of the invention.

The present invention relates to hydrodealkylation/reforming processes employing microporous, crystalline borosilicate molecular sieves. Particular embodiments are described generally with reference to FIGS. 1A, 1B and 1C. In one embodiment, shown in FIG. 1A, FCC heavy gasoline stream 20 and FCC LCO stream 15 are passed from FCC unit 10 to conventional hydrotreating zones, 30 and 25, respectively, for removal of S and N compounds. The effluents of conventional hydrotreating zones 30 and 25 are passed to hydrodealkylation/reforming zones 40 and 35, respectively. At least a portion of the FCC heavy gasoline and FCC LCO are converted to BTX/EB and naphthalene/alkylnaphthalenes. Where the hydrodealkylation/reforming zones are followed by separation zones (not shown), the BTX/EB product is recovered in streams 60 and 50 and the naphthalene/alkylnaphthalenes product is recovered in streams 55 and 45.

Figure 1B:
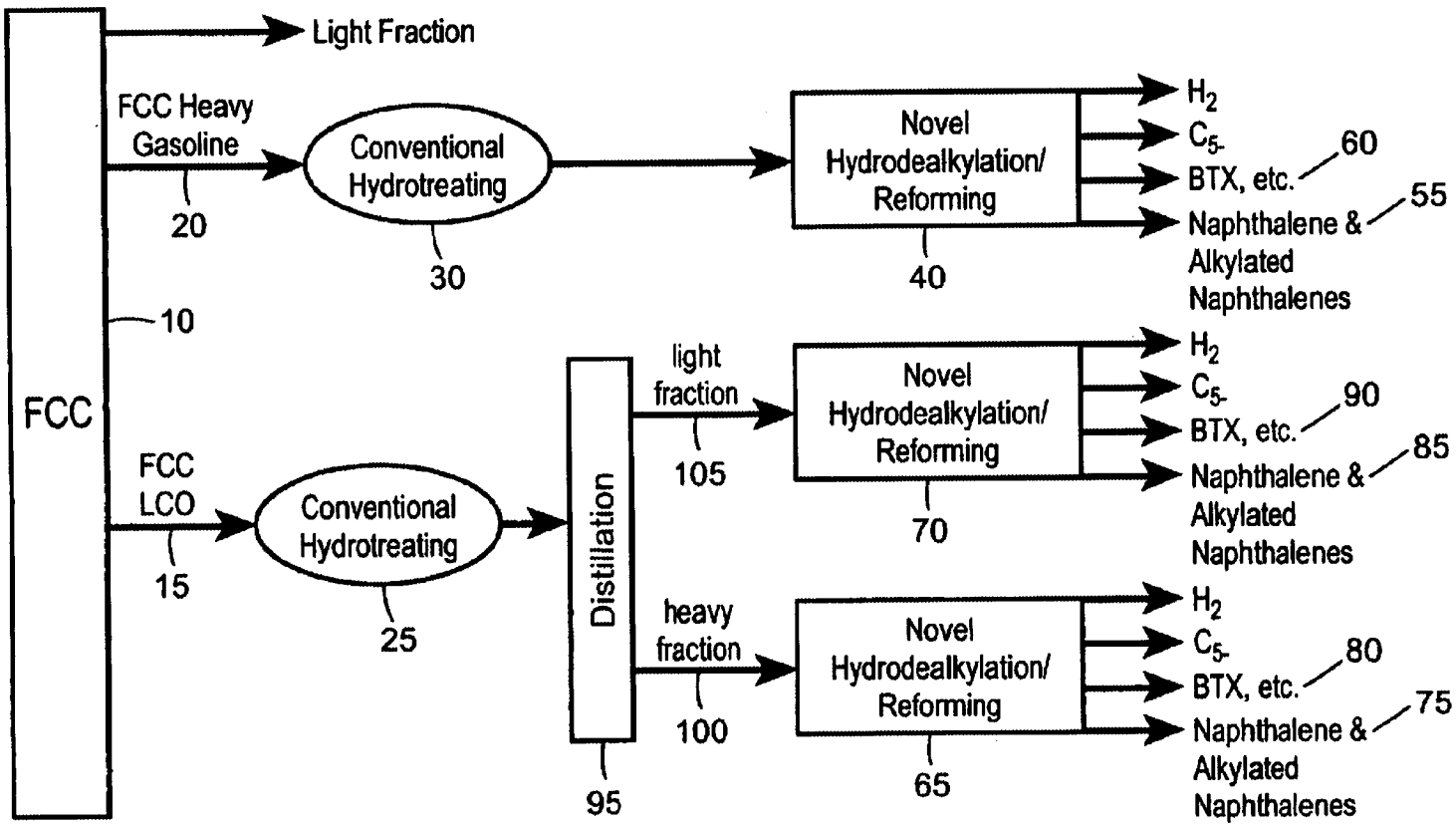

In an alternate embodiment, shown in FIG. 1B, a separation zone 95 follows conventional hydrotreating zone 25. A light fraction 105 and a heavy fraction 100 are passed to hydrodealkylation/reforming zones 70 and 65, respectively. Where the hydrodealkylation/reforming zones 70 and 65 are followed by separation zones (not shown), the BTX/EB product is recovered in streams 90 and 80 and the naphthalene/alkylnaphthalenes product is recovered in streams 85 and 75. All other aspects are the same as the embodiment shown in FIG. 1A.

Figure 1C:
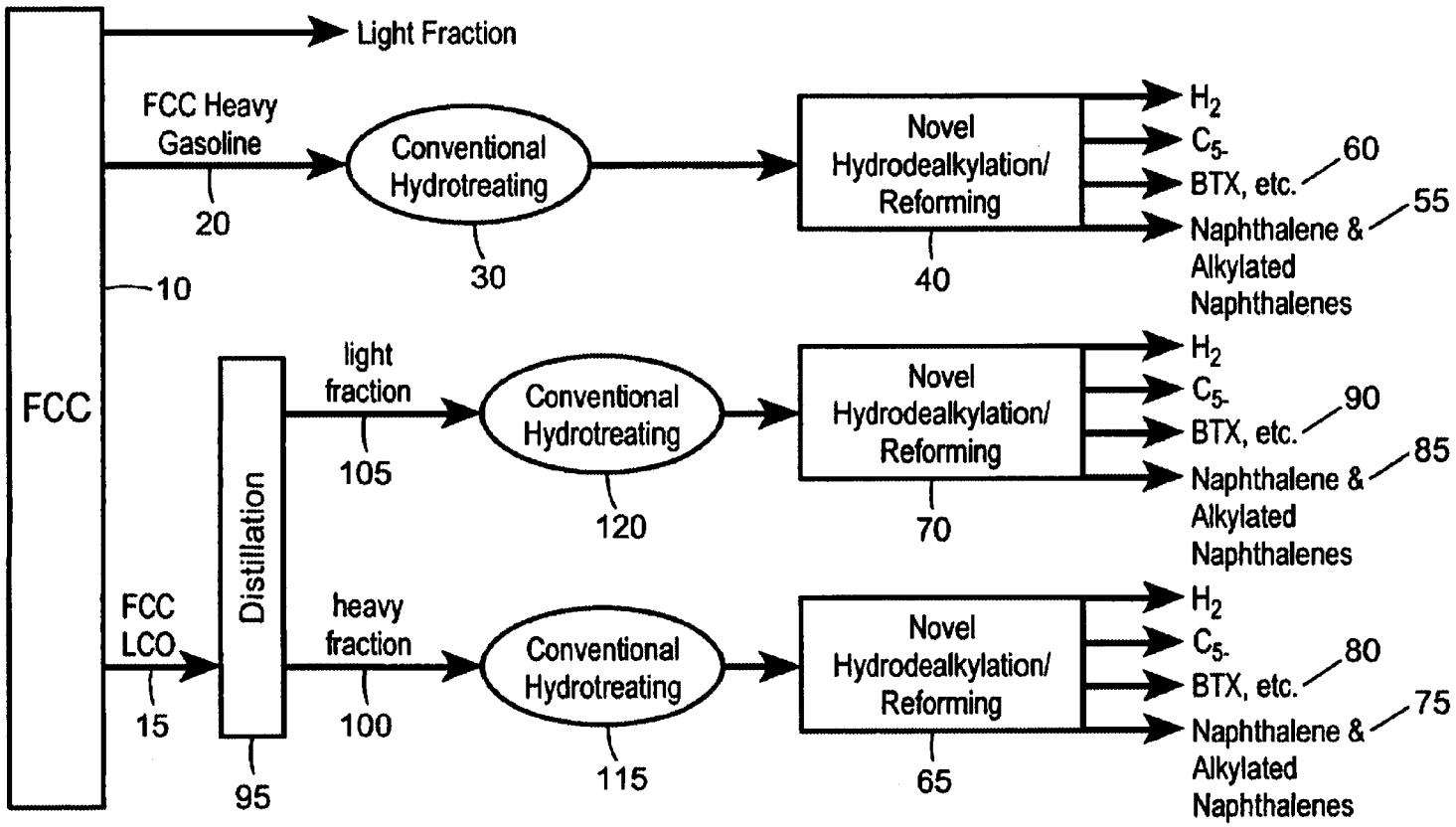
Figure 2:
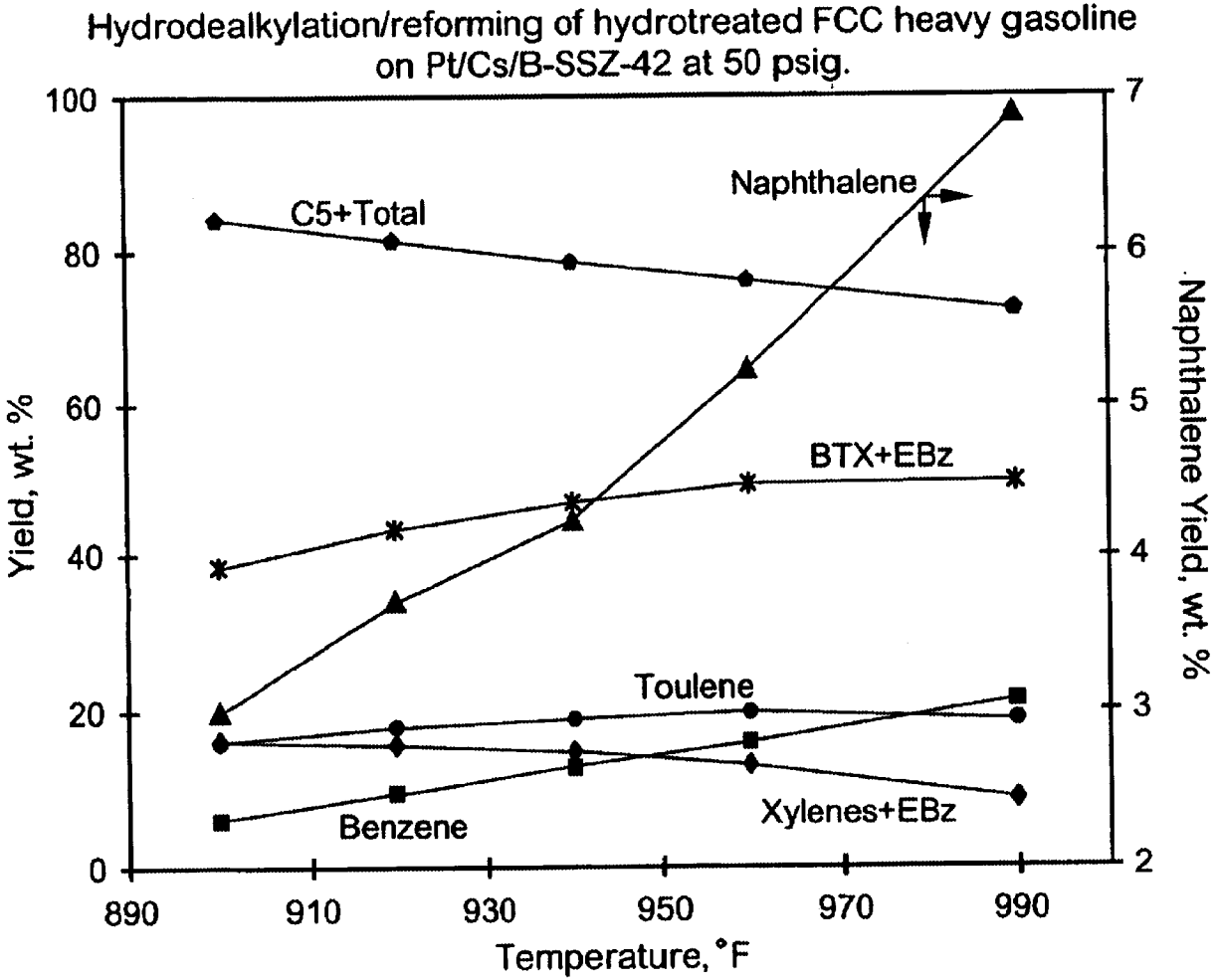
FIG. 2 depicts in one embodiment the temperature dependence of the process of the invention Conditions: 50 psig, hydrocarbon WHSV of 3.0 and molar ratio of hydrogen to hydrocarbon of 3.0.

Another embodiment is shown in FIG. 1C. It is the same as shown in FIG. 1B, except that separation zone 95 precedes the conventional hydrotreating zone and there are 2 conventional hydrotreating zones, zone 120 for the light separation zone fraction 130 and zone 115 for the heavy separation zone fraction 125.

B. Feed

1. Generally

A heavy hydrocarbon feedstream is selected from the group consisting of an FCC effluent, including an FCC light cycle oil, fractions of jet fuels, a Fischer-Tropsch synthesis product, a coker product, coal liquefied oil, the product oil from the heavy oil thermal cracking process, the product oil from heavy oil hydrocracking, straight run cut from a crude unit, and mixtures thereof, and having a major portion boiling from about 350° F. to about 800° F., and preferably from about 350° F. to about 600° F. The term "major portion" as used in this specification and the appended claims, shall mean at least 50 wt. %.

2. Hydrotreating

The feedstream has a sufficiently low sulfur and nitrogen content so that borosilicate molecular sieve of the hydrodealkylation/reforming step of the process of this invention is not deactivated at a rate which would make the process commercially undesirable. In the case of a feed which is not low enough in sulfur and nitrogen, acceptable levels can be reached by hydrotreating the feed with a hydrotreating catalyst in the presence of hydrogen. A low sulfur feed is preferred in the hydrodealkylation/reforming process; but due to the sulfur tolerance of these catalysts, feed desulfurization does not have to be as complete as with conventional reforming catalysts. Upon hydrotreating, the S and N contents of the feedstream is reduced. The content of both S and N is reduced to below (on an elemental basis) 100 ppm, preferably<below 10 ppm, and most preferably<below 1 ppm. Hydrotreating is typically conducted at 500–900° F., at 200–2000 psig, and at a hydrocarbon feed LHSV (Liquid Hourly Space Velocity) of 0.1–10 $h^{-1}$. An example of a suitable catalyst for this hydrotreating process is an alumina-containing support impregnated with molybdenum oxide, cobalt oxide and/or nickel oxide. Processes which are suitable for these purposes are known to those skilled in the art.

C. Catalysts

1. Borosilicate Molecular Sieves

A suitable microporous, crystalline borosilicate molecular sieve is defined herein as a molecular sieve which has a pore size greater than about 5.0 Angstroms, has a Constraint Index below about 1.0 and preferably contains a hydrogenation/dehydrogenation component.

A method of determining the pore size of zeolites is described in *Journal of Catalysis* (1986), Vol. 99, p. 335 (D. S. Santilli). This method allows measurement of the steady-state concentrations of hydrocarbon compounds within the pores of zeolite materials even at temperatures near or at typical reaction conditions. In this method of measurement, zeolites are contacted with a feed consisting of several $C_6$ isomers such as 2,2-dimethylbutane, 3-methylpentane and n-hexane.

The Constraint Index (CI) is another method widely used to characterize the effective pore size and shape selective properties of acidic zeolites. It is based on a comparison of the rates of acid catalyzed cracking of n-hexane and 3-methylpentane. The test is designed to allow discrimination between pore systems composed of 8, 10 and 12+ membered ring (MR) ports. The CI value decreases with the increasing pore size of zeolites. For example, zeolites are often classified based on the CI values as follows: CI<1 for large pore (12 MR) or extra-large pore (14+ MR) zeolites; $1 \leqq CI \leqq 12$ for medium pore (10 MR) zeolites; CI>12 for small pore (8 MR) zeolites. There are many publications on the Constraint Index. Two references are given below:

(i) V. J. Frillette, W. O. Haag and R. M. Lago, *Journal of Catalysis,* 67, 1981, p. 218.

(ii) S. I. Zones and T. V. Harris, *Microporous and Mesoporous Materials,* 35–36, 2000, p. 31.

The Constraint Index of the borosilicate molecular sieves of this process is determined with their aluminosilicate counterparts and amounts to below about 1.0. The borosilicate molecular sieves of this process, optionally, contain trace amounts of aluminum, gallium, germanium, iron, titanium, vanadium, tin or zinc. The borosilicate molecular sieves used in the process of the present invention include, but are not limited to, SSZ-24, SSZ-25, SSZ-31, SSZ-33, SSZ-35, SSZ-37, SSZ-42, SSZ43, SSZ-44, SSZ-47, SSZ-48, CIT-5, UTD-1 and low-aluminum beta (B-beta). These borosilicate molecular sieves possess catalyst activity in the hydrodealkylation/reforming process of the invention. The above examples of the borosilicate molecular sieves are briefly described below.

1.1. SSZ-24

SSZ-24 is described in U.S. Pat. Nos. 4,834,958 and 4,936,977, the disclosures of which are incorporated herein by references. SSZ-24 has a molar ratio greater than about 100:1 of an oxide from silicon oxide, germanium oxide and mixtures thereof to an oxide selected from boron oxide or mixtures of boron oxide with aluminum oxide, gallium oxide and iron oxide. Representative X-ray diffraction data of SSZ-24 are shown in Tables 1a and 1b.

TABLE 1a

X-RAY DIFFRACTION DATA OF AS-SYNTHESIZED SSZ-24

| TWO THETA | d/n | 100 × I/Io |
|---|---|---|
| 7.50 | 11.79 | 98 |
| 13.00 | 6.89 | 10 |
| 15.00 | 5.91 | 46 |
| 19.91 | 4.46 | 100 |
| 21.42 | 4.15 | 36 |
| 22.64 | 3.93 | 87 |
| 26.16 | 3.41 | 44 |
| 29.37 | 3.04 | 13 |
| 30.31 | 2.95 | 30 |
| 34.86 | 2.57 | 20 |
| 38.29 | 2.35 | 7 |

TABLE 1b

X-RAY DIFFRACTION DATA OF CALCINED SSZ-24

| TWO THETA | d/n | 100 × I/Io |
|---|---|---|
| 7.50 | 11.79 | 100 |
| 12.98 | 6.82 | 18 |
| 15.00 | 5.91 | 9 |
| 19.89 | 4.46 | 34 |
| 21.35 | 4.16 | 14 |
| 22.60 | 3.93 | 36 |
| 25.08 | 3.55 | 1 |
| 26.13 | 3.41 | 20 |
| 39.32 | 3.05 | 6 |
| 30.27 | 2.95 | 23 |
| 34.00 | 2.64 | 2 |
| 34.82 | 2.58 | 10 |
| 37.35 | 2.41 | 2 |
| 38.21 | 2.36 | 3 |

1.2. SSZ-25

SSZ-25 is described in U.S. Pat. Nos. 4,826,667, 5,202,014 and 5,421,992, the disclosures of which are incorporated herein by references. SSZ-25 has a molar ratio greater than about 20:1 of an oxide selected from silicon, germanium oxide and mixtures thereof to an oxide selected from boron oxide or mixtures of boron oxide with aluminum oxide, gallium oxide and iron oxide. Representative X-ray diffraction data of SSZ-25 are shown in Tables 2a and 2b.

TABLE 2a

X-RAY DIFFRACTION DATA OF AS-SYNTHESIZED SSZ-25

| TWO THETA | d/n | 100 × I/Io |
|---|---|---|
| 3.05 | 29.00 | 20 |
| 6.42 | 13.77 | 100 |
| 7.18 | 12.31 | 100 |
| 7.88 | 11.22 | 47 |
| 9.62 | 9.19 | 53 |
| 15.75 | 5.63 | 27 |
| 19.37 | 4.58 | 47 |
| 22.57 | 3.94 | 50 |
| 23.05 | 3.86 | 30 |
| 26.03 | 3.42 | 73 |
| 26.85 | 3.32 | 33 |

TABLE 2b

| X-RAY DIFFRACTION DATA OF CALCINED SSZ-25 | | |
|---|---|---|
| TWO THETA | d/n | 100 × I/Io |
| 3.4 | 25.50 | 17 |
| 7.19 | 12.30 | 100 |
| 8.04 | 11.00 | 55 |
| 10.06 | 8.78 | 63 |
| 14.35 | 6.17 | 40 |
| 16.06 | 5.51 | 17 |
| 22.77 | 3.90 | 38 |
| 23.80 | 3.74 | 20 |
| 26.08 | 3.42 | 65 |

1.3. SSZ-31

SSZ-31 is described in U.S. Pat. Nos. 5,106,801 and 5,215,648, the disclosures of which are incorporated herein by references. SSZ-31 has a molar ratio greater than 50:1 of an oxide from silicon oxide, germanium oxide and mixtures thereof to an oxide selected from boron oxide or mixtures of boron oxide with aluminum oxide, gallium oxide and iron oxide. Representative X-ray diffraction data of SSZ-31 are shown in Tables 3a and 3b.

TABLE 3a

| X-RAY DIFFRACTION DATA OF AS-SYNTHESIZED SSZ-31 | | |
|---|---|---|
| TWO THETA | d/n | 100 × I/Io |
| 6.10 | 14.49 | 6 |
| 7.38 | 11.98 | 30 |
| 8.18 | 10.81 | 11 |
| 20.30 | 4.37 | 15 |
| 21.12 | 4.21 | 69 |
| 22.25 | 3.99 | 100 |
| 24.73 | 3.60 | 23 |
| 30.90 | 2.89 | 11 |

TABLE 3b

| X-RAY DIFFRACTION DATA OF CALCINED SSZ-31 | | |
|---|---|---|
| TWO THETA | d/n | 100 × I/Io |
| 6.13 | 14.42 | 65 |
| 7.43 | 11.90 | 52 |
| 8.10 | 10.92 | 33 |
| 18.07 | 4.91 | 12 |
| 20.45 | 4.34 | 10 |
| 21.17 | 4.20 | 150 |
| 21.57 | 4.12 | 10 |
| 22.43 | 3.96 | 75 |
| 24.88 | 3.58 | 27 |
| 31.07 | 2.88 | 8 |

1.4. SSZ-33

SSZ-33 is described in U.S. Pat. Nos. 5,120,425 and 4,963,337, the disclosures of which are incorporated herein by references. SSZ-33 has a molar ratio greater than about 20:1 of an oxide selected from silicon, germanium oxide and mixtures thereof to an oxide selected from boron oxide or mixtures of boron oxide with aluminum oxide, gallium oxide and iron oxide. Representative X-ray diffraction data of SSZ-33 are shown in Tables 4a and 4b.

TABLE 4a

| X-RAY DIFFRACTION DATA OF AS-SYNTHESIZED SSZ-33 | | |
|---|---|---|
| TWO THETA | d/n | 100 × I/Io |
| 7.86 | 11.25 | 90 |
| 20.48 | 4.34 | 100 |
| 21.47 | 4.14 | 40 |
| 22.03 | 4.04 | 90 |
| 23.18 | 3.84 | 64 |
| 26.83 | 3.32 | 40 |

TABLE 4b

| X-RAY DIFFRACTION DATA OF CALCINED SSZ-33 | | |
|---|---|---|
| TWO THETA | d/n | 100 × I/Io |
| 7.81 | 11.32 | 100 |
| 20.43 | 4.35 | 46 |
| 21.44 | 4.14 | 9 |
| 22.02 | 4.04 | 41 |
| 23.18 | 3.84 | 28 |
| 26.80 | 3.33 | 31 |

1.5. SSZ-35

SSZ-35 is described in U.S. Pat. No. 5,316,753, the disclosure of which is incorporated herein by reference. SSZ-35 has a molar ratio greater than about 15:1 of an oxide selected from silicon oxide, germanium oxide and mixtures thereof to an oxide selected from boron oxide or mixtures of boron oxide with aluminum oxide, gallium oxide, iron oxide and titanium oxide. Representative X-ray diffraction data of SSZ-35 are shown in Tables 5a and 5b.

TABLE 5a

| X-RAY DIFFRACTION DATA OF AS-SYNTHESIZED SSZ-35 | | |
|---|---|---|
| TWO THETA | d/n | 100 × I/Io |
| 7.96 | 11.09 | 100 |
| 9.56 | 9.24 | 4 |
| 15.37 | 5.76 | 21 |
| 18.76 | 4.73 | 12 |
| 19.02 | 2.66 | 23 |
| 19.24 | 4.61 | 65 |
| 19.87 | 4.46 | 32 |
| 21.57 | 4.12 | 10 |
| 22.78 | 3.90 | 29 |
| 24.95 | 3.57 | 27 |
| 27.33 | 3.26 | 21 |
| 29.09 | 3.07 | 11 |

TABLE 5b

| X-RAY DIFFRACTION DATA OF CALCINED SSZ-35 | | |
|---|---|---|
| TWO THETA | d/n | 100 × I/Io |
| 8.00 | 11.04 | 100 |
| 9.67 | 9.14 | 16 |
| 15.42 | 5.74 | 2 |
| 19.01 | 4.67 | 8 |
| 19.44 | 4.56 | 12 |
| 19.48 | 4.55 | 13 |
| 19.92 | 4.45 | 7 |
| 21.70 | 4.09 | 3 |
| 22.84 | 3.89 | 5 |
| 24.81 | 3.59 | 7 |
| 27.50 | 3.24 | 5 |
| 29.41 | 3.04 | 4 |

1.6. SSZ-37

SSZ-37 is described in U.S. Pat. No. 5,641,393, the disclosure of which is incorporated herein by reference. SSZ-37 has a molar ratio greater than about 400:1 of an oxide from silicon oxide, germanium oxide and mixtures thereof to an oxide selected from boron oxide or mixtures of boron oxide with aluminum oxide, gallium oxide and iron oxide. Representative X-ray diffraction data of SSZ-37 are shown in Tables 6a and 6b.

TABLE 6a

X-RAY DIFFRACTION DATA OF AS-SYNTHESIZED SSZ-37

| TWO THETA | d/n | RELATIVE INTENSITY |
|---|---|---|
| 7.03 | 12.57 | W |
| 7.82 | 11.29 | S–VS |
| 8.28 | 10.67 | W |
| 10.54 | 8.39 | W(Shoulder) |
| 12.92 | 6.85 | W |
| 19.18 | 4.62 | M |
| 20.04 | 4.43 | W–M |
| 20.42 | 4.35 | VS |
| 22.22 | 4.00 | VS |
| 22.66 | 3.92 | W |
| 23.74 | 3.75 | W |
| 25.88 | 3.44 | W–M |
| 26.57 | 3.35 | W |
| 27.12 | 3.29 | S |

The X-ray diffraction pattern provided is based on a relative intensity scale in which the strongest line in the X-ray pattern is assigned a value of 100; W (weak) is less than 20; M (medium) is between 20 and 40; S (strong) is between 40 and 60; VS (very strong) is greater than 60.

TABLE 6b

X-RAY DIFFRACTION DATA OF CALCINED SSZ-37

| TWO THETA | d/n | RELATIVE INTENSITY |
|---|---|---|
| 7.05 | 12.53 | W |
| 7.94 | 11.13 | VS |
| 8.36 | 10.57 | M |
| 10.63 | 8.31 | W(Shoulder) |
| 12.95 | 6.83 | W |
| 19.29 | 4.60 | M |
| 20.26 | 4.38 | W |
| 20.64 | 4.30 | S |
| 22.39 | 3.97 | W–M |
| 22.78 | 3.90 | W |
| 23.61 | 3.77 | W |
| 26.10 | 3.41 | W |
| 26.74 | 3.33 | W |
| 27.34 | 3.26 | W–M |

1.7. SSZ-42

SSZ-42 is described in U.S. Pat. No. 5,653,956, the disclosure of which is incorporated herein by reference. SSZ-42 has a molar ratio greater than about 15:1 of an oxide from silicon oxide, germanium oxide and mixtures thereof to an oxide selected from boron oxide or mixtures of boron oxide with aluminum oxide, gallium oxide, iron oxide and titanium oxide. Representative X-ray diffraction data of SSZ-42 are shown in Tables 7a and 7b.

TABLE 7a

X-RAY DIFFRACTION DATA OF AS-SYNTHESIZED SSZ-42

| TWO THETA | d/n | 100 × I/Io |
|---|---|---|
| 8.26 | 10.70 | 70 |
| 9.76 | 9.05 | 7 |
| 16.54 | 5.36 | 15 |
| 19.16 | 4.63 | 21 |
| 20.64 | 4.30 | 100 |
| 21.58 | 4.12 | 23 |
| 21.80 | 4.07 | 49 |
| 23.72 | 3.75 | 10 |
| 23.92 | 3.72 | 35 |
| 24.96 | 3.57 | 11 |
| 25.38 | 3.51 | 12 |
| 26.24 | 3.39 | 26 |
| 26.78 | 3.33 | 26 |
| 29.46 | 3.03 | 18 |

TABLE 7b

X-RAY DIFFRACTION DATA OF CALCINED SSZ-42

| TWO THETA | d/n | 100 × I/Io |
|---|---|---|
| 8.22 | 10.75 | 100 |
| 9.76 | 9.06 | 13 |
| 16.42 | 5.39 | 3 |
| 19.22 | 4.62 | 7 |
| 20.48 | 4.33 | 30 |
| 20.84 | 4.26 | 25 |
| 21.48 | 4.13 | 7 |
| 21.72 | 4.09 | 16 |
| 23.68 | 3.75 | 6 |
| 24.06 | 3.70 | 15 |
| 24.96 | 3.57 | 10 |
| 25.40 | 3.50 | 6 |
| 26.60 | 3.35 | 20 |
| 29.56 | 3.02 | 10 |

1.8. SSZ-43

SSZ-43 is described in U.S. Pat. No. 5,965,104, the disclosure of which is incorporated herein by reference. SSZ-43 has a molar ratio greater than 50:1 of an oxide from silicon oxide, germanium oxide and mixtures thereof to an oxide selected from boron oxide or mixtures of boron oxide with aluminum oxide, gallium oxide, iron oxide, titanium oxide, indium oxide, and vanadium. Representative X-ray diffraction data of SSZ-43 are shown in Tables 8a and 8b.

TABLE 8a

X-RAY DIFFRACTION DATA OF AS-SYNTHESIZED SSZ-43

| TWO THETA | d/n | RELATIVE INTENSITY |
|---|---|---|
| 6.2 | 14.2 | W |
| 7.5 | 11.8 | M |
| 7.8 | 11.3 | M– |
| 8.1 | 10.9 | M |
| 21.0 | 4.24 | VS |
| 21.5 | 4.13 | S |
| 22.5 | 3.95 | S |
| 23.2 | 3.83 | M |
| 25.6 | 3.48 | M |
| 27.2 | 3.27 | W |

TABLE 8b

| X-RAY DIFFRACTION DATA OF CALCINED SSZ-43 | | |
|---|---|---|
| TWO THETA | d/n | RELATIVE INTENSITY |
| 6.2 | 14.2 | M–S |
| 7.5 | 11.8 | W–M |
| 7.8 | 11.3 | W–M |
| 8.1 | 10.9 | W–M |
| 21.0 | 4.24 | VS |
| 21.5 | 4.13 | VS |
| 22.5 | 3.95 | S |
| 23.2 | 3.83 | M |
| 25.6 | 3.48 | W |
| 27.2 | 3.27 | W |

1.9. SSZ-44

SSZ-44 is described in U.S. Pat. No. 5,580,540, the disclosure of which is incorporated herein by reference. SSZ-44 has a molar ratio greater than about 20:1 of an oxide selected from silicon oxide, germanium oxide and mixtures thereof to an oxide selected from boron oxide or mixtures of boron oxide with aluminum oxide, gallium oxide, iron oxide, titanium oxide, indium oxide and vanadium oxide. Representative X-ray diffraction data of SSZ-44 are shown in Tables 9a and 9b.

TABLE 9a

| X-RAY DIFFRACTION DATA OF AS-SYNTHESIZED SSZ-44 | | |
|---|---|---|
| TWO THETA | d/n | RELATIVE INTENSITY |
| 7.7 | 11.4 | M |
| 8.0 | 11.0 | VS |
| 8.7 | 10.2 | M |
| 16.0 | 5.6 | M |
| 19.0 | 4.6 | VS |
| 19.6 | 4.5 | M |
| 20.5 | 4.3 | M |
| 21.6 | 4.1 | M |
| 23.7 | 3.8 | M |
| 25.5 | 3.5 | S |

TABLE 9b

| X-RAY DIFFRACTION DATA OF CALCINED SSZ-44 | | |
|---|---|---|
| TWO THETA | d/n | RELATIVE INTENSITY |
| 7.7 | 11.4 | M–S |
| 8.0 | 11.0 | VS |
| 8.7 | 10.2 | S–VS |
| 16.0 | 5.5 | W |
| 19.2 | 4.6 | M |
| 19.6 | 4.5 | W |
| 20.5 | 4.3 | W |
| 21.6 | 4.1 | W |
| 23.8 | 3.7 | W |
| 25.6 | 3.5 | W |

1.10. SSZ-47

SSZ-47 is described in U.S. Pat. No. 6,156,290, the disclosure of which is incorporated herein by reference. SSZ-47 has a molar ratio greater than 20:1 of an oxide from silicon oxide, germanium oxide and mixtures thereof to an oxide selected from boron oxide or mixtures of boron oxide with aluminum oxide, gallium oxide, iron oxide, titanium oxide, indium oxide and vanadium oxide. Representative X-ray diffraction data of SSZ-47 are shown in Tables 10a and 10b.

TABLE 10a

| X-RAY DIFFRACTION DATA OF AS-SYNTHESIZED SSZ-47 | | |
|---|---|---|
| TWO THETA | d/n | RELATIVE INTENSITY |
| 8.0 | 11.0 | M |
| 9.6 | 9.19 | W |
| 19.20 | 4.62 | M |
| 20.65 | 4.30 | VS |
| 22.35 | 3.97 | S |
| 24.05 | 3.69 | M |
| 26.10 | 3.41 | W |
| 26.65 | 3.34 | W |

TABLE 10b

| X-RAY DIFFRACTION DATA OF CALCINED SSZ-47 | | |
|---|---|---|
| TWO THETA | d/n | RELATIVE INTENSITY |
| 8.0 | 11.0 | S |
| 9.6 | 9.19 | W |
| 19.20 | 4.62 | S |
| 20.65 | 4.30 | VS |
| 22.35 | 3.97 | S |
| 24.05 | 3.70 | W–M |
| 26.10 | 3.41 | W |
| 26.65 | 3.34 | W–M |
| 27.35 | 3.26 | S |
| 35.65 | 2.52 | W |

1.11. SSZ-48

SSZ-48 is described in U.S. Pat. No. 6,080,382, the disclosure of which is incorporated herein by reference. SSZ-48 has a molar ratio greater than about 40:1 of an oxide selected from silicon oxide, germanium oxide and mixtures thereof to an oxide selected from boron oxide or mixtures of boron oxide with aluminum oxide, gallium oxide, iron oxide, titanium oxide, indium oxide and vanadium oxide. Representative X-ray diffraction data of SSZ-48 are shown in Tables 11a and 11b.

TABLE 11a

| X-RAY DIFFRACTION DATA OF AS-SYNTHESIZED SSZ-48 | | |
|---|---|---|
| TWO THETA | d/n | RELATIVE INTENSITY |
| 6.6 | 13.5 | S |
| 8.0 | 11.0 | VS |
| 9.4 | 9.40 | M |
| 11.3 | 7.82 | M–W |
| 20.1 | 4.42 | VS |
| 22.7 | 3.91 | VS |
| 24.1 | 3.69 | VS |
| 26.5 | 3.36 | S |
| 27.9 | 3.20 | S |
| 35.9 | 2.50 | M |

TABLE 11b

| X-RAY DIFFRACTION DATA OF CALCINED SSZ-48 | | |
|---|---|---|
| TWO THETA | d/n | RELATIVE INTENSITY |
| 6.6 | 13.5 | VS |
| 8.0 | 11.0 | VS |
| 9.4 | 9.40 | S |
| 11.3 | 7.82 | M |
| 20.1 | 4.42 | M |
| 22.7 | 3.91 | M |

TABLE 11b-continued

| X-RAY DIFFRACTION DATA OF CALCINED SSZ-48 | | |
|---|---|---|
| TWO THETA | d/n | RELATIVE INTENSITY |
| 24.1 | 3.69 | M |
| 26.5 | 3.36 | M |
| 27.9 | 3.20 | W |
| 35.9 | 2.50 | W |

1.12. CIT-5

CIT-5 is described in U.S. Pat. No. 6,40,258, the disclosure of which is incorporated herein by reference. CIT-5 has a molar ratio greater than about 40:1 of an oxide selected from silicon oxide, germanium oxide and mixtures thereof to an oxide selected from boron oxide or mixtures of boron oxide with aluminum oxide, gallium oxide and iron oxide. Representative X-ray diffraction data of CIT-5 are shown in Tables 12a and 12b.

TABLE 12a

| X-RAY DIFFRACTION DATA OF AS-SYNTHESIZED CIT-5 | | |
|---|---|---|
| TWO THETA | d/n | 100 × I/Io |
| 7.00 | 12.62 | 100 |
| 7.29 | 12.12 | 25 |
| 13.97 | 6.33 | 58 |
| 18.99 | 4.67 | 73 |
| 19.60 | 4.53 | 18 |
| 20.03 | 4.43 | 41 |
| 20.52 | 4.32 | 31 |
| 21.00 | 4.23 | 90 |
| 21.98 | 4.04 | 6 |
| 23.45 | 3.79 | 9 |
| 24.25 | 3.67 | 5 |
| 24.66 | 3.61 | 31 |
| 26.75 | 3.33 | 45 |
| 27.15 | 3.28 | 13 |
| 28.13 | 3.17 | 22 |
| 28.23 | 3.16 | 23 |
| 35.68 | 2.52 | 8 |
| 36.49 | 2.46 | 7 |
| 44.75 | 2.02 | 9 |

TABLE 12b

| X-RAY DIFFRACTION DATA OF CALCINED CIT-5 | | |
|---|---|---|
| TWO THETA | d/n | 100 × I/Io |
| 6.92 | 12.76 | 100 |
| 7.30 | 12.10 | 86 |
| 12.24 | 7.23 | 11 |
| 12.92 | 6.85 | 6 |
| 13.87 | 6.38 | 7 |
| 18.99 | 4.67 | 40 |
| 19.73 | 4.50 | 11 |
| 20.04 | 4.43 | 31 |
| 20.51 | 4.33 | 26 |
| 20.88 | 4.25 | 26 |
| 23.44 | 3.79 | 5 |
| 24.61 | 3.61 | 18 |
| 26.92 | 3.31 | 29 |
| 27.27 | 3.27 | 8 |
| 28.22 | 3.16 | 16 |
| 31.37 | 2.85 | 5 |
| 35.69 | 2.51 | 7 |

1.13. UTD-1

UTD-1 is described in U.S. Pat. No. 6,103,215, the disclosure of which is incorporated herein by reference. UTD-1 has a molar ratio of about 500:1 or less of an oxide selected from silicon oxide, germanium oxide and mixtures thereof to an oxide selected from boron oxide or mixtures of boron oxide with aluminum oxide, gallium oxide, iron oxide and indium oxide. Representative X-ray diffraction data of UTD-1 are shown in Tables 13a and 13b.

TABLE 13a

| X-RAY DIFFRACTION DATA OF AS-SYNTHESIZED UTD-1 | | |
|---|---|---|
| TWO THETA | d/n | 100 × I/Io |
| 5.94 | 14.9 | 26 |
| 7.46 | 11.8 | 33 |
| 12.0 | 7.4 | 25 |
| 14.6 | 6.08 | 28 |
| 18.1 | 4.90 | 21 |
| 19.4 | 4.57 | 30 |
| 21.2 | 4.19 | 100 |
| 22.1 | 4.02 | 43 |
| 22.5 | 3.95 | 28 |
| 24.4 | 3.65 | 19 |

TABLE 13b

| X-RAY DIFFRACTION DATA OF CALCINED UTD-1 | | |
|---|---|---|
| TWO THETA | d/n | 100 × I/Io |
| 6.09 | 14.5 | 94 |
| 7.71 | 11.5 | 49 |
| 14.7 | 6.04 | 9 |
| 18.3 | 4.86 | 12 |
| 19.9 | 4.46 | 16 |
| 20.3 | 4.37 | 8 |
| 21.3 | 4.17 | 100 |
| 22.1 | 4.01 | 15 |
| 22.6 | 3.92 | 10 |
| 24.4 | 3.64 | 9 |
| 25.0 | 3.56 | 10 |
| 26.3 | 3.39 | 9 |
| 28.4 | 3.15 | 9 |
| 29.4 | 3.04 | 7 |
| 32.6 | 2.75 | 8 |

1.14. Low-Aluminum Boron-Beta

Low-aluminum boron-beta zeolites (B-beta) and their preparation are described, e.g., in U.S. Pat. Nos. 5,166,111 and 5,393,407, the disclosures of which are incorporated herein by references. Low-aluminum boron-beta has a molar ratio greater than about 10:1 of an oxide selected from silicon oxide, germanium oxide and mixtures thereof to an oxide selected from boron oxide or mixtures of boron oxide with aluminum oxide, gallium oxide and iron oxide, wherein the amount of aluminum is less than 0.10% by weight. Representative X-ray diffraction data of B-beta are shown in Tables 14a and 14b.

TABLE 14a

| X-RAY DIFFRACTION DATA OF AS-SYNTHESIZED B-BETA | | | |
|---|---|---|---|
| TWO THETA | d/n | 100 × I/Io | SHAPE |
| 7.7 | 11.5 | 25 | broad |
| 18.40 | 4.82 | 8 | very broad |
| 21.44 | 4.14 | 18 | |
| 22.53 | 3.95 | 100 | |
| 27.50 | 3.24 | 10 | |
| 28.92 | 3.10 | 8 | broad |
| 29.90 | 2.97 | 9 | |

TABLE 14b

X-RAY DIFFRACTION DATA OF CALCINED B-BETA

| TWO THETA | d/n | 100 × I/Io | SHAPE |
|---|---|---|---|
| 7.7 | 11.5 | 85 | broad |
| 13.58 | 6.52 | 9 | |
| 14.87 | 5.96 | 12 | broad |
| 18.50 | 4.80 | 3 | very broad |
| 21.83 | 4.07 | 15 | |
| 22.87 | 3.89 | 100 | broad |
| 27.38 | 3.26 | 10 | |
| 29.30 | 3.05 | 6 | broad |
| 30.08 | 2.97 | 8 | |

2. Hydrogenation/Dehydrogenation Neutralizing Components and Binders

The borosilicate molecular sieve catalysts of this process may contain a metal selected from the group consisting of a Group VIIIA metal, a Group VIIA metal, a Group IIIB–VB metal, and mixtures thereof, and optionally a Group IA and/or Group IIA metal cation. When used in this disclosure, the Periodic Table of the Elements referred to is the version published by the CRC Press in the *CRC Handbook of Chemistry and Physics,* 75th Edition (1994–1995). The names for families of the elements in the Periodic Table are given here in the previous IUPAC form.

2.1. Group VIIIA Metal and Other Metal Component

The borosilicate molecular sieve of this process may contain a Group VIIIA metal component. The Group VIIIA metal compound should provide sufficient activity for the catalyst to have commercial use. By Group VIIIA metal compound, as used herein, is meant the metal itself or a compound thereof. The Group VIIIA metals include the Group VIIIA metals and their compounds, for example, platinum, palladium, and iridium, or combinations thereof can be used. The preferred metal is platinum. Other transition metals such as Group VIIA metals (e.g., rhenium) are useful. Group IIIB–VB metals such as gallium, indium, germanium, tin and/or lead may also be used in the form of metal itself or a compound thereof in conjunction with the Group VIIIA metal.

The aforementioned metals can be incorporated into the borosilicate molecular sieves by any one of numerous procedures, for example, by co-milling, impregnation, or ion exchange. Processes which are suitable for these purposes are known to those skilled in the art. The amount of Group VIIIA metal present in the borosilicate molecular sieve catalyst should be within the normal range of use for hydrodealkylation/reforming catalysts, preferably a range of from about 0.05 wt. % to about 10.0 wt. %, more preferably from about 0.1 wt. % and about 5.0 wt. %, and most preferably from about 0.1 wt. % to about 2.0 wt. %. Other transition metals such as Group VIIA metals (e.g., rhenium) and Group IIIB–VB metals such as gallium, indium, germanium, tin and/or lead may be used in the same range of amount.

2.2. Group IA or Group IIA Metal Cation

The catalytic activity of the borosilicate molecular sieve hydrodealkylation/reforming catalysts of the present invention is related to the activity of the well-dispersed metal (e.g., Pt, Pd, Ir, Rh, Ru, Re, Pb. Sn, Ge, In, Ga, etc.) particles and optionally to some acidity from the borosilicate molecular sieve. Conventional reforming catalysts are made with very low acidity or substantially free of acidity, to reduce the tendency toward excessive cracking which leads to low liquid yields. As described by P. W. Tamm et al. (in *Studies in Surface Science and Catalysis*, Vol. 38, Edited by J. W. Ward, publisher: Elsevier/Amsterdam, 1988, p. 335), in the extreme case of zeolite L (which is an aluminosilicate and could be used in the very selective service of producing benzene in a reforming reaction of light hydrocarbon streams mainly containing C6 paraffins), considerable effort has been made to eliminate all the acidity in order to suppress the undesirable cracking reactions caused by the unnecessary acidity. While boron T-sites in the borosilicate molecular sieve framework are generally considered to be weak acidic centers (M. Taramasso et al., in *Proceedings of the 5th International Conference on Zeolites*, edited by L. V. C. Rees, publisher: Heyden/London, 1980, p. 40), at elevated temperatures (such as those typical of the hydrodealkylation/reforming of the present invention) and with noble metals (e.g., Pt) capable of generating olefinic intermediates, these boron T-sites can contribute some acidity leading to enhanced cracking activity. As such, the acidity of the borosilicate molecular sieve may need to be moderated or neutralized, e.g., via the titration with alkali or alkaline-earth cations. Depending on the compositions of the feed and the quality/quantity requirements of the hydrodealkylation/reforming products, the content of the alkali or alkaline-earth cations in this neutralization step may be varied to adjust the acidity of catalyst and flexibly contribute to the effective hydrodealkylation/reforming of heavy feeds from different sources. The acidity of borosilicate molecular sieves and the adjustment of the acidity of a catalyst are discussed in U.S. Pat. No. 5,114,565, the disclosure of which is incorporated herein by reference. When a relatively high acidity is needed for the hydrodealkylation/reforming of certain heavy feeds, the borosilicate molecular sieve hydrodealkylation/reforming catalyst can be also used without the aforementioned neutralization pretreatment using Group IA and/or Group IIA metal cations; furthermore, the borosilicate molecular sieve may also contain a small amount of other elements such as aluminum or gallium in the framework, in case an even higher acidity is needed for the hydrodealkylation/reforming of some heavy feeds. In addition, the acidity of the borosilicate molecular sieve hydrodealkylation/reforming catalyst may be also adjusted by varying the Si/B ratio of the borosilicate molecular sieves.

The borosilicate molecular sieves are usually prepared from mixtures containing Group IA metal hydroxides and, thus, have Group IA metal contents of about 0.5–2 wt. %. These high levels of Group IA metal, usually sodium or potassium, are unacceptable for most other catalytic applications because they deactivate the catalyst by reducing catalyst acidity. Therefore, the Group IA metal is removed to low levels by ion exchange, e.g., with hydrogen or ammonium ions, for most of catalytic applications. By Group IA metals as used herein is meant alkali metal cations or their basic compounds. Surprisingly, unless the borosilicate molecular sieve itself is already neutralized, the Group IA (or Group IIA) metal may be required in the present process to reduce acidity and improve aromatics production, as discussed above. Group IA or Group IIA metals are incorporated by impregnation or ion exchange using nitrate, chloride, carbonate salts or hydroxide. Processes which are suitable for these purposes are known to those skilled in the art. The Group IA cation optionally contained in the borosilicate molecular sieve is selected from the group consisting of cesium, rubidium, potassium, sodium, lithium, and mixtures thereof. The Group IIA cation is selected from the group consisting of barium, strontium, calcium, magnesium, and mixtures thereof.

The molar ratio of said Group IA or Group IIA metal cation to boron is preferably from about 0 to about 20. In one embodiment, the borosilicate molecular sieve contains cesium and platinum, where the molar ratio of cesium to boron is from about 0 to about 4.0.

2.3. Binders

The borosilicate molecular sieve hydrodealkylation/reforming catalysts of the present invention can be used with or without a binder or matrix. The preferred inorganic matrix, where one is used, is a silica-, alumina- or silica/alumina-based binder. Other matrices such as magnesia, titania, vanadia, chromia, zirconia, and mixtures thereof can be used. The preferred inorganic matrix is non-acidic or low-acidic.

D. Hydrodealkylation/Reforming Reactions

In the hydrodealkylation/reforming reactions, at least a portion of the feed is converted to BTX (benzene, toluene and xylenes) and other products listed in the "Products" section below. In the reactions, the hydrodealkylation refers to the removal of alkyl groups from the aromatic ring of heavy aromatics.

E. Products

The products include BTX (benzene, toluene and xylenes), EB (ethylbenzene), naphthalene, alkylnaphthalenes such as methylnaphthalenes and dimethylnaphthalenes, other aromatics such as trimethylbenzenes, and any combination thereof. Preferably, the BTX/EB fraction is clean, i.e., without substantial amount of other hydrocarbons such as paraffins, olefins and/or naphthenes in this cut.

F. Process Conditions

The contacting of the heavy hydrocarbon feedstream with the borosilicate molecular sieve based catalyst is under catalytic hydrodealkylation/reforming conditions. Typically, the contacting of the hydrocarbon feed with the borosilicate molecular sieve catalyst occurs at a temperature in the range of from about 700° F. to 1000° F., at pressures ranging from atmospheric to 500 psig, hydrocarbon feed WHSV (Weight Hourly Space Velocity) ranging from 0.1 to 15 $h^{-1}$, and a molar ratio of hydrogen to hydrocarbon ranging from about 0.1 to 20. Where there is only partial conversion of the hydrocarbon feedstock, the process optionally includes a separation stage for recovering at least a portion of the unconverted feedstock. At least a portion of any unconverted feedstock is then, optionally, recycled to the hydrodealkylation/reforming unit. In case the catalyst is deactivated by coke deposit or other poisons, the catalyst activity can be rejuvenated via regeneration. Processes which are suitable for regeneration are known to those skilled in the art.

G. Process Equipment

According to a preferred embodiment, the borosilicate molecular sieve based catalysts described herein may be used in a single-stage or multi-stage catalytic hydrodealkylation/reforming process. These borosilicate molecular sieve based catalysts used in the process of this invention may be located in one or more of the reactors. The process of the present invention can be also integrated with the conventional reforming process, namely, by hydrodealkylating/reforming heavy hydrocarbon feedstreams with these borosilicate molecular sieve based catalysts located in one or more of the reactors while reforming lighter feedstocks with conventional reforming catalysts (such as Pt—Re/$Al_2O_3$/Cl or Pt/K—L) located in the other reactors. The hydrodealkylation/reforming process may be accomplished by using fixed beds, fluid beds or moving beds for contacting the hydrocarbon feedstream with the catalysts.

H. Benefits

We have found catalysts based on the borosilicate molecular sieves described herein, which are prepared such that this acidity is adjusted, to have high activity and selectivity for hydrodealkylation/reforming reactions. These catalysts have low pressure stability in not only reforming of light naphtha feeds but also hydrodealkylation/reforming of heavy feeds having major portion thereof boiling from 350° F. to about 800° F. such as jet fuel fractions, and light cycle oil fractions, coker product, coal liquefied oil, the product oil from the heavy oil thermal cracking process, the product oil from heavy oil hydrocracking, straight run cut from a crude unit, and mixtures thereof. For example, in some embodiments the catalysts have been stable at pressures as low as 50 psig; such a low pressure is favorable over higher pressure (e.g., 200 psig) for reforming in terms of thermodynamic equilibrium but is not feasible with the conventional reforming catalysts due to the poor stability of the latter. Therefore, the catalysts of the present invention can be operated for longer catalyst cycle times under stable conditions. Furthermore, with heavy feeds, these catalysts give a clean BTX/EB fraction with very low levels of other hydrocarbons such as paraffins, olefins and/or naphthenes in the BTX/EB boiling range. Therefore, the product would not need further purification steps such as solvent extraction to remove these paraffin non-aromatic compounds from the BTX/EB fraction. Unlike some conventional catalysts, e.g., Pt/K—L zeolite catalysts, the catalysts of this invention are sulfur-tolerant and recover from sulfur upsets. As a result, the sulfur protection requirements are much less stringent. These catalysts can, therefore, be used to convert lower value heavy feeds such as jet fuels, FCC heavy gasoline and FCC LCO to high octane gasoline and higher value petrochemical feedstocks.

VI. ILLUSTRATIVE EMBODIMENTS

In experiments described below, various hydrodealkylation/reforming catalysts were prepared and used for converting hydrotreated fractions of FCC LCO. In these experiments, there was little evidence of deactivation of the catalysts with these heavy feeds, in some cases after up to approximately 1500 hours of continuous use. It was also found in these experiments that these catalysts were sulfur-tolerant and produced very clean BTX/EB cuts, i.e., without substantial amount of other hydrocarbons such as paraffins, olefins and/or naphthenes in the BTX/EB boiling range. In fact, better selectivities to BTX/EB as well as naphthalene and alkylated naphthalenes can be achieved if the various conditions are adjusted.

Index for Examples

| | |
|---|---|
| Example 1 | Synthesis of B-SSZ-33 |
| Example 2 | Synthesis of B-SSZ-42 |
| Example 3 | Preparation of Pt/Cs/B-SSZ-33 |
| Example 4 | Preparation of Pt/B-SSZ-33 |
| Example 5 | Preparation of Pt/Cs/B-SSZ-42 |
| Example 6 | Preparation of Pt/K/B-SSZ-42 |
| Example 7 | Preparation of Pt/Na/B-SSZ-42 |
| Example 8 | Preparation of Pt/B-SSZ-42 |
| Example 9 | Pretreatment of Hydrodealkylation/Reforming Catalysts |
| Example 10 | Procedure of Hydrodealkylation/Reforming Testing |
| Example 11 | Hydrotreated Fraction (#1) of FCC Light Cycle Oil |
| Example 12 | Hydrotreated Fraction (#2) of FCC Light Cycle Oil |
| Example 13 | Hydrodealkylation/Reforming of Hydrotreated FCC LCO Fraction (#1) on Pt/B-SSZ-33 |

-continued

| Index for Examples | |
|---|---|
| Example 14 | Hydrodealkylation/Reforming of Hydrotreated FCC LCO Fraction (#1) on Pt/Cs/B-SSZ-33 |
| Example 15 | Hydrodealkylation/Reforming of Hydrotreated FCC LCO Fraction (#1) on Pt/B-SSZ-42 |
| Example 16 | Hydrodealkylation/Reforming of Hydrotreated FCC LCO Fraction (#1) on Pt/Cs/B-SSZ-42 |
| Example 17 | Hydrodealkylation/Reforming of Hydrotreated FCC LCO Fraction (#2) on Pt/B-SSZ-33 |

| Index for Tables | |
|---|---|
| Table 1 | X-ray diffraction data of SSZ-24. |
| Table 2 | X-ray diffraction data of SSZ-25. |
| Table 3 | X-ray diffraction data of SSZ-31. |
| Table 4 | X-ray diffraction data of SSZ-33. |
| Table 5 | X-ray diffraction data of SSZ-35. |
| Table 6 | X-ray diffraction data of SSZ-37. |
| Table 7 | X-ray diffraction data of SSZ-42. |
| Table 8 | X-ray diffraction data of SSZ-43. |
| Table 9 | X-ray diffraction data of SSZ-44. |
| Table 10 | X-ray diffraction data of SSZ-47. |
| Table 11 | X-ray diffraction data of SSZ-48. |
| Table 12 | X-ray diffraction data of CIT-1. |
| Table 13 | X-ray diffraction data of UTD-1. |
| Table 14 | X-ray diffraction data of B-beta. |
| Table 15 | Simulated distillation data of hydrotreated FCC LCO fractions by ASTM 2887–89. |
| Table 16 | Hydrodealkylation/reforming of hydrotreated FCC LCO fraction (#1) in Pt/B-SSZ-33 catalyst. |
| Table 17 | Hydrodealkylation/reforming of hydrotreated FCC LCO fraction (#1) in Pt/Cs/B-SSZ-33 catalyst. |
| Table 18 | Hydrodealkylation/reforming of hydrotreated FCC LCO fraction (#1) in Pt/B-SSZ-42 catalyst. |
| Table 19 | Hydrodealkylation/reforming of hydrotreated FCC LCO fraction (#1) in Pt/Cs/B-SSZ-42 catalyst. |
| Table 20 | Hydrodealkylation/reforming of hydrotreated FCC LCO fraction (#2) in Pt/B-SSZ-33 catalyst. |

EXAMPLES

The present invention will be further described with the following examples showing the results of several experiments.

Preparation of Hydrodealkylation/Reforming Catalysts

Examples 1–8

Example 1

Synthesis of B-SSZ-33

2.0 Moles of trimethylammonium-8-tricyclo [5.2.1.0] decane in 3700 ml of water were mixed with 3600 ml of water, 92 grams of boric acid and 39 grams of solid NaOH. Once a clear solution was obtained, 558 grams of Cabosil M-5 were blended in and 5 grams of as-made B-SSZ-33 seed material were added. The entire contents had been mixed in the Hastelloy liner used in a 5-gallon autoclave (Autoclave Engineers). The reaction mixture was stirred overnight at 200 rpm and at room temperature. Next, the reactor was ramped up to 160° C. over 12 hours and the stirring rate dropped to 75 rpm. The reaction mixture was held under these conditions for 10 days of run time. The recovered, settled product was crystalline B-SSZ-33 in accord with U.S. Pat. No. 4,963,337.

A portion of the as-synthesized B-SSZ-33 product prepared above was calcined as follows. The sample was heated in a muffle furnace from room temperature up to 540° C. at a steadily increasing rate over a seven-hour period. The sample was maintained at 540° C. for four more hours and then taken up to 600° C. for additional four hours. The atmosphere was nitrogen at a rate of 20 standard cubic feet per minute with a small amount of air being bled into the flow. The calcined product had the X-ray diffraction pattern lines in accord with U.S. Pat. No. 4,963,337. The elemental analysis of the crystalline product gave a molar Si/B ratio of 18.

Example 2

Synthesis of B-SSZ-42

3 Millimoles of N-benzyl-1,4-diazabicyclo[2.2.2]octane hydroxide as a 5.5 ml aqueous solution was used to dissolve 0.06 grams of sodium borate decahydrate. 0.6 grams of Cab-O-Sil® M-5 silica were then slurried into the resulting solution. The reaction mixture was heated in a Teflon® cup of a stainless steel reactor at 150° C. for 17 days without agitation. The recovered, settled product was crystalline B-SSZ-42 in accord with U.S. Patent 5,653,956.

The as-synthesized B-SSZ-42 product prepared above was calcined as follows. The sample was heated in a muffle furnace from room temperature up to 600° C. in stages and under a stream of nitrogen with a small air bleed. The stages were to 125° C. at 50° C./hour, hold for 2 hours, 50° C./hour to 540° C., hold for 4 hours, 50° C./hour to 600° C. with a final hold for 4 hours. The calcined B-SSZ-42 product had the X-ray diffraction pattern lines in accord with U.S. Pat. No. 5,653,956. The elemental analysis of the crystalline product gives a molar Si/B ratio of 22.

Example 3

Preparation of Pt/Cs/B—SSZ-33

A sample of Cs-neutralized B-SSZ-33 was prepared by suspending 10.7 g of B-SSZ-33 (prepared in Example 1) in 81.0 g of water. 2.0 Gram of CsOH solution (containing 66,450 ppm Cs) was added to 27.0 g water. The resulting CsOH solution was added to the zeolite slurry with hand shaking, and the hand shaking continued for another three minutes. The suspension was then placed on a shaker and shaken at room temperature for 24 hours.

The suspension was filtered and the resulting solid was air dried at room temperature overnight. The resulting solid was calcined in air with the following temperature program:

from room temperature to 250° F. at a heating rate of 1° F./minute, at 250° F. for 16 hours, from 250° F. to 570° F. at a heating rate of 1.8° F./minute, at 570° F. for 2 hours, cool down from 570° F. to room temperature within 5 hours.

The Cs/B-SSZ-33 prepared above was further exchanged to make Pt/Cs/B-SSZ-33. 5.6 Gram of the above Cs/B-SSZ-33 was suspended in 40.2 g of water. $Pt(NH_3)_4Cl_2 \cdot H_2O$ (98.3 mg) was added to 13.0 g water. The resulting Pt solution was added to the zeolite slurry with hand shaking, and hand shaking continued for three minutes. Then the suspension was placed on a shaker and shaken at room temperature for 24 hours. The suspension was filtered and the resulting solid was air dried at room temperature overnight. The resulting solid was calcined in air with the same temperature program as used for Cs/B-SSZ-33 above. The elemental analysis results indicate that the resulting Pt/Cs/B-SSZ-33 contains 1.5 wt. % Pt and 1.9 wt. % Cs.

The resulting Pt/Cs/B-SSZ-33 was tested for hydrodealkylation/reforming of heavy feeds in Example 14.

Example 4

Preparation of Pt/B-SSZ-33

A platinum-containing B-SSZ-33 sample, without the neutralization treatment with any alkali hydroxide solution described in Example 3, was prepared by suspending 10.2 g of B-SSZ-33 (prepared in Example 1) in 80.2 g of water. $Pt(NH_3)_4Cl_2.H_2O$ (180.0 mg) was added to 25.0 g water. The resulting Pt solution was added to the zeolite slurry with hand shaking, and hand shaking continued for three minutes. Then the suspension was placed on a shaker and shaken at room temperature for 24 hours. The suspension was filtered and the resulting solid was air dried at room temperature overnight. The resulting solid was calcined in air with the following temperature program:

from room temperature to 250° F. at a heating rate of 1° F./minute, at 250° F. for 16 hours, from 250° F. to 570° F. at a heating rate of 1.8° F./minute, at 570° F. for 2 hours, cool down from 570° F. to room temperature within 5 hours.

The elemental analysis results indicate that the resulting Pt/B-SSZ-33 contains 0.9 wt. % Pt. The resulting Pt/B-SSZ-33 was tested for hydrodealkylation/reforming of heavy feeds in Examples 13 and 17.

Example 5

Preparation of Pt/Cs/B-SSZ-42

A sample of cesium-neutralized B-SSZ-42 was prepared by suspending 11.3 g of B-SSZ-42 (prepared as described in Example 2) in 80.0 g of water. 2.0 Gram of CsOH solution (containing 66,450 ppm Cs) was added to 23.0 g water. The resulting CsOH solution was added to the zeolite slurry with hand shaking, and the hand shaking continued for another three minutes. The suspension was then placed on a shaker and shaken at room temperature for 24 hours.

The suspension was filtered and the resulting solid was air dried at room temperature overnight. The resulting solid was calcined in air with the following temperature program:

from room temperature to 250° F. at a heating rate of 1° F./minute, at 250° F. for 16 hours, from 250° F. to 570° F. at a heating rate of 1.8° F./minute, at 570° F. for 2 hours, cool down from 570° F. to room temperature within 5 hours.

The Cs/B-SSZ-42 prepared above was further exchanged to make Pt/Cs/B-SSZ-42. 9.9 Gram of the above Cs/B-SSZ-42 was suspended in 81.5 g of water. $Pt(NH_3)_4Cl_2.H_2O$ (87.1 mg) was added to 25.0 g water. The resulting Pt solution was added to the zeolite slurry with hand shaking, and hand shaking continued for three minutes. Then the suspension was placed on a shaker and shaken at room temperature for 24 hours. The suspension was filtered and the resulting solid was air dried at room temperature overnight. The resulting solid was calcined in air with the same temperature program as used for Cs/B-SSZ-42 above. The elemental analysis results indicate that the resulting Pt/Cs/B-SSZ-42 contains 0.6 wt. % Pt and 1.6 wt. % Cs.

The resulting Pt/Cs/B-SSZ-42 was tested for hydrodealkylation/reforming of heavy feeds in Example 16.

Example 6

Preparation of Pt/K/B-SSZ-42

A sample of potassium-neutralized B-SSZ-42 was prepared by suspending 4.0 g of B-SSZ-42 (prepared as described in Example 2) in 30.5 g of water. 0.7 Gram of KOH solution (containing 19,548 ppm K) was added to 8.4 g water. The resulting KOH solution was added to the zeolite slurry with hand shaking, and the hand shaking continued for another three minutes. The suspension was then placed on a shaker and shaken at room temperature for 24 hours.

The suspension was filtered and the resulting solid was air dried at room temperature overnight. The resulting solid was calcined in air with the following temperature program:

from room temperature to 250° F. at a heating rate of 1° F./minute, at 250° F. for 16 hours, from 250° F. to 570° F. at a heating rate of 1.8° F./minute, at 570° F. for 2 hours, cool down from 570° F. to room temperature within 5 hours.

The K/B-SSZ-42 prepared above was further exchanged to make Pt/K/B-SSZ-42. 3.7 Gram of the above K/B-SSZ-42 was suspended in 30.0 g of water. $Pt(NH_3)_4Cl_2.H_2O$ (32.6 mg) was added to 11.0 g water. The resulting Pt solution was added to the zeolite slurry with hand shaking, and hand shaking continued for three minutes. Then the suspension was placed on a shaker and shaken at room temperature for 24 hours. The suspension was filtered and the resulting solid was air dried at room temperature overnight. The resulting solid was calcined in air with the same temperature program as used for K/B-SSZ-42 above. The elemental analysis results indicate that the resulting Pt/K/B-SSZ-42 contains 0.6 wt. % Pt and 0.5 wt. % K.

Example 7

Preparation of Pt/Na/B-SSZ-42

A sample of sodium-neutralized B-SSZ-42 was prepared by suspending 4.1 g of B-SSZ-42 (prepared as described in Example 2) in 31.1 g of water. 0.7 Gram of NaOH solution (containing 11,494 ppm Na) was added to 8.4 g water. The resulting NaOH solution was added to the zeolite slurry with hand shaking, and the hand shaking continued for another three minutes. The suspension was then placed on a shaker and shaken at room temperature for 24 hours.

The suspension was filtered and the resulting solid was air dried at room temperature overnight. The resulting solid was calcined in air with the following temperature program:

from room temperature to 250° F. at a heating rate of 1° F./minute, at 250° F. for 16 hours, from 250° F. to 570° F. at a heating rate of 1.8° F./minute, at 570° F. for 2 hours, cool down from 570° F. to room temperature within 5 hours.

The Na/B-SSZ-42 prepared above was further exchanged to make Pt/Na/B-SSZ-42. 3.8 Gram of the above Na/B-SSZ- 42 was suspended in 30.0 g of water. $Pt(NH_3)_4Cl_2.H_2O$ (33.6 mg) was added to 11.0 g water. The resulting Pt solution was added to the zeolite slurry with hand shaking, and hand shaking continued for three minutes. Then the suspension was placed on a shaker and shaken at room temperature for 24 hours. The suspension was filtered and the resulting solid was air dried at room temperature overnight. The resulting solid was calcined in air with the same temperature program as used for Na/B-SSZ-42 above. The elemental analysis results indicate that the resulting Pt/Na/B-SSZ-42 contains 0.6 wt. % Pt and 0.4 wt. % Na.

Example 8

Preparation of Pt/B-SSZ-42

A platinum-containing B-SSZ-42 sample, without the neutralization treatment with any alkali hydroxide solutions described in Examples 5–7, was prepared by suspending 5.0 g of B-SSZ-42 (prepared as described in Example 2) in 40.5 g of water. $Pt(NH_3)_4Cl_2.H_2O$ (44.1 mg) was added to 12.0 g water. The resulting Pt solution was added to the zeolite slurry with hand shaking, and hand shaking continued for three minutes. Then the suspension was placed on a shaker and shaken at room temperature for 24 hours. The suspension was filtered and the resulting solid was air dried at room temperature overnight. The resulting solid was calcined in air with the following temperature program:

from room temperature to 250° F. at a heating rate of 1° F./minute, at 250° F. for 16 hours, from 250° F. to 570° F. at a heating rate of 1.8° F./minute, at 570° F. for 2 hours, cool down from 570° F. to room temperature within 5 hours.

The elemental analysis results indicate that the resulting Pt/B-SSZ-42 contains 0.6 wt. % Pt. The resulting Pt/B-SSZ-42 was tested for hydrodealkylation/reforming of heavy feeds in Example 15.

Catalyst Pretreatment and Testing Procedure

Examples 9–10

Example 9

Pretreatment of Hydrodealkylation/Reforming Catalysts

The hydrodealkylation/reforming catalysts prepared in Examples 3–8 were sulfided to reduce the hydrogenolysis activity. The sulfiding reactions were conducted in down flow fixed bed reactor systems. The procedure is described as follows:

The catalysts were meshed to 24–40 chips and then loaded into the center of the stainless steel tube reactors. The catalysts (0.45 g dry for each experiment) were first dried in a $N_2$ flow (300 cc/min) from room temperature to 400° F. at a heating rate of 10° F./min and kept at 400° F. for 30 minutes. For the reduction of the platinum in the catalysts, the catalysts were subsequently heated in a $H_2$ flow (300 cc/min) from 400° F. to 900° F. at a heating rate of 5° F./min and kept at 900° F. for 30 minutes. Finally, the catalysts were cooled down to 800° F. to start the sulfiding reactions.

The feed applied for sulfiding reactions was anhydrous n-octane containing 200 ppm sulfur (as dimethyl disulfide). The sulfur present in the feed was used to reduce the hydrogenolysis activity of the Pt species dispersed in the borosilicate molecular sieves to a lower value. The sulfiding was typically carried out at 800° F. and atmospheric pressure for 60 minutes. The $H_2$ and liquid feed flow rates were 30 cc/min and 0.43 cc/min, respectively. After sulfiding, the catalysts were heated in a $H_2$ flow (300 cc/min) from 800 to 900° F. within minutes and then at 900° F. for another 30 minutes in order to remove the excess sulfur species occluded in the pores and/or on the surface of the catalysts. Finally, the catalysts were cooled down to room temperature within 5 hours in the same $H_2$ flow (300 cc/min). After this pretreatment, the catalysts were used for hydrodealkylation/reforming experiments.

Example 10

Procedure of Hydrodealkylation/Reforming Testing

Immediately after the sulfiding step, the stainless steel tube reactor containing the sulfided catalyst was transferred from sulfiding system to another down flow fixed bed reactor system. The hydrodealkylation/reforming reactions were conducted there under various conditions, as described in the examples below.

Prior to the hydrodealkylation/reforming testing, the sulfided catalysts were first purged in a $N_2$ flow (100 cc/min) from room temperature to 400° F. at a heating rate of 10° F./min and kept at 400° F. for 30 minutes. Further, the catalysts were subsequently heated in a $H_2$ flow (100 cc/min) from 400° F. to 900° F. at a heating rate of 5° F./min and kept at 900° F. for 30 minutes. Finally, the catalysts were heated up or cooled down to the preset hydrodealkylation/reforming temperature (e.g., 900° F.). At the same time, the reactor system was pressurized to the preset pressure (e.g., 50 psig). Meanwhile, the $H_2$ flow was adjusted to the preset rate (e.g., 15 cc/min). The feed rate was typically 0.5–1.5 cc/hour. In the following examples, the hydrodealkylation/reforming experiments were carried out at hydrocarbon WHSV of 3.0 and molar ratio of hydrogen to hydrocarbon of 3.0.

The hydrodealkylation/reforming products and unconverted feed were analyzed using on-line GC when the hydrotreated FCC LCO fraction #1 of Example 12 was used as feed. With the hydrotreated heavier FCC LCO fraction #2 of Example 13 as feed, the liquid hydrodealkylation/reforming products and unconverted feed were collected for a period of every 12–24 hours and analyzed using off-line GC; the gas products were analyzed with a wet test meter (for gas flow rate measurement) in association with both on-line and off-line GC analysis. In addition, GC/MS was also used to confirm the product identification.

Feeds Used in the Examples of Catalytic Testing

Examples 11–12

Example 11

Hydrotreated Fraction (#1) of FCC Light Cycle Oil

A FCC Light Cycle Oil (LCO) stream was distilled into various fractions of different boiling ranges.

One of the fractions was hydrotreated over a conventional Mo/Ni hydrotreating catalyst at 1700 psig, 660° F. and WHSV of 2.1 $h^{-1}$. Upon hydrotreating, the sulfur and nitrogen levels of this fraction were reduced from 2225 ppm S and 283 ppm N to 0.03 ppm S and 0.1 ppm N, respectively. The simulated distillation data (ASTM 2887-89) of this hydrotreated LCO fraction is listed in Table 15. This feed was tested in Examples 13–16.

TABLE 15

SIMULATED DISTILLATION DATA OF HYDROTREATED FCC LCO FRACTIONS BY ASTM 2887–89

| Volume Percent Intervals | Temperature, ° F. Fraction (#1) (Example 12) | Fraction (#2) (Example 13) |
|---|---|---|
| 0.1 | 276 | 239 |
| 0.5 | 282 | 255 |
| 5 | 354 | 431 |
| 10 | 365 | 451 |
| 15 | 375 | 464 |
| 20 | 387 | 474 |
| 25 | 394 | 482 |
| 30 | 399 | 489 |
| 35 | 403 | 495 |
| 40 | 408 | 500 |
| 45 | 414 | 505 |
| 50 | 420 | 511 |
| 55 | 426 | 517 |
| 60 | 433 | 523 |
| 65 | 440 | 529 |
| 70 | 446 | 535 |
| 75 | 454 | 539 |
| 80 | 461 | 545 |
| 85 | 470 | 551 |
| 90 | 482 | 559 |
| 95 | 499 | 569 |
| 99 | 523 | 582 |
| 99.5 | 525 | 583 |

Example 12

Hydrotreated Fraction (#2) of FCC Light Cycle Oil

Another fraction collected via the distillation of the FCC Light Cycle Oil (LCO) stream (see Example 11) was hydrotreated over a conventional Mo/Ni hydrotreating catalyst at 1700 psig, 660° F. and WHSV of 2.1 $h^{-1}$. Upon hydrotreating, the sulfur and nitrogen levels of this fraction were reduced from 3242 ppm S and 457 ppm N to 0.02 ppm S and 0.1 ppm N, respectively. The simulated distillation data (ASTM 2887-89) of this hydrotreated LCO fraction is listed in Table 15. This feed was tested in Example 17.

Hydrodealkylation/Reforming of Hydrotreated FCC Light Cycle Oil

Examples 13–17

Example 13

Hydrodealkylation/Reforming of Hydrotreated FCC LCO Fraction (#1) on Pt/B-SSZ-33

The Pt/B-SSZ-33 catalyst of Example 4 (0.9 wt. % Pt) was screened with the hydrotreated FCC LCO fraction (#1) of Example 12 under various conditions. The catalyst pretreatment and the catalytic testing procedure are described in Examples 9–10. The catalyst was screened under continuous use as follows: (1) first with the hydrotreated FCC LCO fraction (#1) containing 0.03 ppm S of Example 12 under various conditions, (2) subsequently with the same feed but doped with 1 ppm sulfur (as dimethyl disulfide) for about 200 hours, (3) finally again with the FCC LCO fraction (#1) containing 0.03 ppm S of Example 12. In this example, the hydrotreated FCC LCO fraction (#1) containing 0.03 ppm S of Example 12 is referred to as hydrotreated sulfur-free FCC LCO fraction (#1) because of this very low sulfur level. The catalyst made clean BTX/EB products and was stable for over about 1500 hours under continuous use at various conditions, including about 200 hours in the presence of 1 ppm S in the feed. The results are presented in Table 16. Up to ~35% BTX/EB and ~20% naphthalene were produced. The results also indicate that this catalyst has good sulfur tolerance in response to sulfur upsets in this fraction of FCC LCO feed.

TABLE 16

HYDRODEALKYLATION/REFORMING OF HYDROTREATED FCC LCO FRACTION (#1) IN Pt/B-SSZ-33 CATALYST

| Temperature, ° F. | 900 | 920 | 920 | 920 | 950 | 920 |
|---|---|---|---|---|---|---|
| Pressure, psig | 130 | 130 | 80 | 130 | 130 | 130 |
| Sulfur Status | S free | S free | S free | 1 ppm S | 1 ppm S | S free |
| Yield, wt. % | | | | | | |
| $C_5$ + Total | 69.7 | 65.4 | 72.2 | 76.0 | 67.1 | 66.5 |
| Benzene | 6.4 | 9.2 | 6.7 | 4.5 | 8.8 | 8.4 |
| Toluene | 12.3 | 14.8 | 12.3 | 9.7 | 14.5 | 14.1 |
| Xylenes/EB | 9.7 | 9.5 | 9.6 | 9.3 | 9.6 | 9.5 |
| Total BTX/EB | 28.4 | 33.5 | 28.4 | 23.5 | 32.9 | 32.0 |
| Naphthalene | 19.2 | 19.9 | 22.2 | 17.9 | 22.1 | 20.0 |
| Methylnaphthalenes | 5.2 | 2.7 | 7.2 | 9.6 | 3.3 | 3.2 |
| Selectivity in $C_5$+, wt. % | | | | | | |
| Benzene | 9.2 | 14.1 | 9.3 | 5.9 | 13.1 | 12.6 |
| Toluene | 17.7 | 22.6 | 17.0 | 12.8 | 21.6 | 21.2 |
| Xylenes/EB | 13.9 | 14.5 | 13.3 | 12.2 | 14.3 | 14.3 |
| Total BTX/EB | 40.8 | 51.2 | 39.3 | 30.9 | 49.0 | 48.1 |
| Naphthalene | 27.6 | 30.4 | 30.8 | 23.6 | 32.9 | 30.1 |
| Methylnaphthalenes | 7.5 | 4.1 | 10.0 | 12.6 | 4.9 | 4.8 |

Example 14

Hydrodealkylation/Reforming of Hydrotreated FCC LCO Fraction (#1) on Pt/Cs/B-SSZ-33

The Pt/Cs/B-SSZ-33 catalyst of Example 3 (1.5 wt. % Pt and 1.9 wt. % Cs) was screened with the hydrotreated FCC LCO fraction (#1) of Example 12 at various conditions. The catalyst pretreatment and the catalytic testing procedure are described in Examples 9–10. The catalyst was screened under continuous use as follows: (1) first with the hydrotreated FCC LCO fraction (#1) containing 0.03 ppm S of Example 12 under various conditions, (2) subsequently with the same feed but doped with 1 ppm sulfur (as dimethyl disulfide) for about 250 hours, (3) finally again with the FCC LCO fraction (#1) containing 0.03 ppm S of Example 12. In this example, the hydrotreated FCC LCO fraction (#1) containing 0.03 ppm S of Example 12 is referred to as hydrotreated sulfur-free FCC LCO fraction (#1) because of this very low sulfur level. The catalyst made clean BTX/EB products and was stable for over about 1000 hours under continuous use at various conditions, including about 250 hours in the presence of 1 ppm S in the feed. The results are presented in Table 17. Up to ~40% BTX/EB or ~27% naphthalene was produced. The results also indicate that this catalyst has good sulfur tolerance in response to sulfur upsets in this fraction of FCC LCO feed.

TABLE 17

HYDRODEALKYLATION/REFORMING OF HYDROTREATED FCC LCO FRACTION (#1) IN Pt/Cs/B-SSZ-33 CATALYST

| Temperature, ° F. | 920 | 950 | 950 | 970 | 970 | 950 | 970 | 950 |
|---|---|---|---|---|---|---|---|---|
| Pressure, psig | 130 | 130 | 80 | 130 | 200 | 130 | 130 | 130 |
| Sulfur Status | S free | S free | S free | S free | S free | 1 ppm S | 1 ppm S | S free |
| Yield, wt. % | | | | | | | | |
| $C_5$ + Total | 75.0 | 69.1 | 71.9 | 63.9 | 49.5 | 76.2 | 72.1 | 70.3 |
| Benzene | 4.7 | 9.2 | 8.3 | 11.5 | 21.6 | 5.6 | 7.9 | 8.4 |
| Toluene | 9.4 | 14.7 | 13.8 | 14.6 | 14.1 | 11.1 | 13.5 | 14.3 |
| Xylenes/EB | 9.1 | 9.0 | 8.9 | 7.8 | 4.3 | 9.3 | 9.2 | 9.2 |
| Total BTX/EB | 23.2 | 32.9 | 31.0 | 33.9 | 40.0 | 26.0 | 30.6 | 31.9 |
| Naphthalene | 16.9 | 24.5 | 27.4 | 21.8 | 7.0 | 22.6 | 25.1 | 23.8 |
| Methylnaphthalenes | 9.8 | 2.7 | 4.6 | 2.5 | 0.2 | 8.1 | 4.8 | 3.3 |
| Selectivity in $C_5$+, wt. % | | | | | | | | |
| Benzene | 6.3 | 13.3 | 11.5 | 18.0 | 43.6 | 7.4 | 11.0 | 12.0 |
| Toluene | 12.5 | 21.3 | 19.2 | 22.9 | 28.5 | 14.6 | 18.7 | 20.3 |
| Xylenes/EB | 12.1 | 13.0 | 12.4 | 12.2 | 8.7 | 12.2 | 12.8 | 13.1 |
| Total BTX/EB | 30.9 | 47.6 | 43.1 | 53.1 | 80.8 | 34.2 | 42.5 | 45.4 |
| Naphthalene | 22.5 | 35.5 | 38.1 | 34.1 | 14.1 | 29.7 | 34.8 | 33.9 |
| Methylnaphthalenes | 13.1 | 3.9 | 6.4 | 3.9 | 0.4 | 10.6 | 6.7 | 4.7 |

Example 15

Hydrodealkylation/Reforming of Hydrotreated FCC LCO Fraction (#1) on Pt/B-SSZ-42

The Pt/B-SSZ-42 catalyst of Example 8 (0.6 wt. % Pt) was screened with the hydrotreated FCC LCO fraction (#1) containing 0.03 ppm S of Example 12 under various conditions. The catalyst pretreatment and the catalytic testing procedure are described in Examples 9–10. The results are presented in Table 18. Up to ~35% BTX/EB or ~17% naphthalene was produced. The catalyst made clean BTX/EB products and was stable under continuous use at various conditions used here.

TABLE 18

HYDRODEALKYLATION/REFORMING OF HYDROTREATED FCC LCO FRACTION (#1) IN Pt/B-SSZ-42 CATALYST

| Temperature,° F. | 920 | 950 | 970 | 970 |
|---|---|---|---|---|
| Pressure, psig | 130 | 130 | 80 | 200 |
| Yield, wt. % | | | | |
| $C_5$ + Total | 74.3 | 59.8 | 54.2 | 43.5 |
| Benzene | 6.2 | 15.9 | 21.0 | 22.9 |
| Toluene | 9.8 | 12.9 | 11.2 | 9.5 |
| Xylenes/EB | 7.8 | 5.2 | 3.4 | 2.6 |
| Total BTX/EB | 23.8 | 34.0 | 35.6 | 35.0 |
| Naphthalene | 16.8 | 16.1 | 13.4 | 5.4 |
| Methylnaphthalenes | 7.8 | 1.3 | 0.6 | 0.3 |
| Selectivity in $C_5$ +, wt. % | | | | |
| Benzene | 8.4 | 26.6 | 38.8 | 52.6 |
| Toluene | 13.2 | 21.6 | 20.7 | 21.8 |
| Xylenes/EB | 10.5 | 8.7 | 6.3 | 6.0 |
| Total BTX/EB | 32.1 | 56.9 | 65.8 | 80.4 |
| Naphthalene | 22.6 | 26.9 | 24.7 | 12.4 |
| Methylnaphthalenes | 10.5 | 2.2 | 1.1 | 0.7 |

Example 16

Hydrodealkylation/Reforming of Hydrotreated FCC LCO Fraction (#1) on Pt/Cs/B-SSZ-42

The Pt/Cs/B-SSZ-42 catalyst of Example 5 (0.6 wt. % Pt and 1.6 wt. % Cs) was screened with the hydrotreated FCC LCO fraction (#1) containing 0.03 ppm S of Example 12 under various conditions. The catalyst pretreatment and the catalytic testing procedure are described in Examples 9–10. The results are presented in Table 19. Up to ~23% BTX/EB and ~25% naphthalene were produced. The catalyst made clean BTX/EB products and was stable under continuous use at various conditions used here.

TABLE 19

HYDRODEALKYLATION/REFORMING OF HYDROTREATED FCC LCO FRACTION (#1) IN Pt/Cs/B-SSZ-42

| Temperature, ° F. | 920 | 950 |
|---|---|---|
| Pressure, psig | 130 | 130 |
| Yield, wt. % | | |
| $C_5$ + Total | 85.5 | 79.4 |
| Benzene | 3.6 | 6.9 |
| Toluene | 5.4 | 9.0 |
| Xylenes/EB | 5.4 | 6.8 |
| Total BTX/EB | 14.4 | 22.7 |
| Naphthalene | 17.8 | 25.2 |
| Methylnaphthalenes | 14.1 | 7.9 |
| Selectivity in $C_5$ + wt. % | | |
| Benzene | 4.2 | 8.7 |
| Toluene | 6.3 | 11.3 |
| Xylenes/EB | 6.3 | 8.6 |
| Total BTX/EB | 16.8 | 28.6 |
| Naphthalene | 20.8 | 31.7 |
| Methylnaphthalenes | 16.5 | 10.0 |

Example 17

Hydrodealkylation/Reforming of Hydrotreated FCC LCO Fraction (#2) on Pt/B-SSZ-33

The Pt/B-SSZ-33 catalyst of Example 4 (0.9 wt. % Pt) was screened with the hydrotreated FCC LCO fraction (#2) containing 0.02 ppm S of Example 12 under various conditions. The catalyst pretreatment and the catalytic testing procedure are described in Examples 9–10. The catalyst was screened under continuous use as follows: (1) first with the hydrotreated FCC LCO fraction (#2) containing 0.02 ppm S of Example 12 under various conditions, (2) subsequently with the same feed but doped with 1 ppm sulfur (as dimethyl disulfide) for about 170 hours, (3) finally again with the FCC LCO fraction (#2) containing 0.02 ppm S of Example 13. In this example, the hydrotreated FCC LCO fraction (#2) containing 0.02 ppm S of Example 12 is referred to as hydrotreated sulfur-free FCC LCO fraction (#2) because of this very low sulfur level. The catalyst made clean BTX/EB products and was stable for over about 1400 hours under continuous use at various conditions, including about 170 hours in the presence of 1 ppm S in the feed. The results are presented in Table 20. Up to ~27% BTX/EB or ~13% naphthalene was produced. The results also indicate that this catalyst has good sulfur tolerance in response to sulfur upsets in this fraction of FCC LCO feed.

TABLE 20

HYDRODEALKYLATION/REFORMING OF HYDROTREATED FCC LCO FRACTION (#2) IN Pt/B-SSZ-33 CATALYST

| Temperature, ° F. | 970 | 950 | 950 | 970 | 970 | 970 |
|---|---|---|---|---|---|---|
| Pressure, psig | 300 | 200 | 130 | 80 | 200 | 200 |
| Sulfur Status | S free | S free | S free | S free | 1 ppm S | S free |
| Yield, wt. % | | | | | | |
| $C_5$ + Total | 50.2 | 71.5 | 75.5 | 76.3 | 74.3 | 68.1 |
| Benzene | 14.0 | 8.5 | 7.0 | 9.3 | 7.9 | 10.1 |
| Toluene | 9.7 | 10.0 | 8.6 | 9.6 | 10.0 | 9.7 |
| Xylenes/EB | 2.9 | 3.5 | 3.5 | 3.3 | 4.5 | 3.4 |
| Total BTX/EB | 26.7 | 22.0 | 19.1 | 22.2 | 22.4 | 23.2 |
| Naphthalene | 7.5 | 10.8 | 10.9 | 12.9 | 10.8 | 10.3 |
| Methylnaphthalenes | 1.0 | 5.7 | 7.5 | 7.2 | 6.6 | 4.1 |
| Selectivity in $C_5$+, wt. % | | | | | | |
| Benzene | 27.9 | 11.9 | 9.3 | 12.2 | 10.6 | 14.8 |
| Toluene | 19.3 | 14.0 | 11.4 | 12.6 | 13.5 | 14.2 |
| Xylenes/EB | 5.8 | 4.9 | 4.6 | 4.3 | 6.1 | 5.0 |
| Total BTX/EB | 53.2 | 30.8 | 25.3 | 29.1 | 30.2 | 34.0 |
| Naphthalene | 14.9 | 15.1 | 14.4 | 16.9 | 14.5 | 15.1 |
| Methylnaphthalenes | 2.0 | 8.0 | 9.9 | 9.4 | 8.9 | 6.0 |

What is claimed is:

1. A catalytic hydrodealkylation/reforming process which comprises:

(a) contacting a heavy hydrocarbon feedstream having a major portion thereof boiling from about 350° F. to about 800° F. under catalytic hydrodealkylation/reforming conditions with a catalyst comprising a borosilicate molecular sieve having a pore size greater than about 5.0 Angstroms and a Constraint Index smaller than about 1.0, and further containing a hydrogenation/dehydrogenation component; and (b) wherein at least a portion of said heavy hydrocarbon feedstream is converted to a product comprising benzene, toluene, xylenes and ethylbenzene, and (c) recovering a product stream comprising benzene, toluene, xylenes and ethylbenzene.

2. The process in accordance with claim 1, wherein said borosilicate molecular sieve is selected from the group consisting of SSZ-24, SSZ-25, SSZ-31, SSZ-33, SSZ-35, SSZ-37, SSZ-42, SSZ-43, SSZ-44, SSZ-47, SSZ-48, CIT-5, UTD-1, low-aluminum boron-beta, and mixtures thereof.

3. The process in accordance with claim 1, wherein said heavy hydrocarbon feedstream has a major portion thereof boiling from about 350° F. to about 600° F.

4. The process in accordance with claim 1, wherein said heavy hydrocarbon feedstream is selected from the group consisting of an FCC light cycle oil, a jet fuel, a Fischer-Tropsch synthesis product, a coker product, a coal liquefied oil, a product oil from the heavy oil thermal cracking process, a product oil from heavy oil hydrocracking, a straight run cut from a crude unit, and mixtures thereof.

5. The process in accordance with claim 1, wherein said borosilicate molecular sieves further comprises trace amounts of aluminum, gallium, germanium, iron, titanium, vanadium, tin, or zinc.

6. The process in accordance with claim 1, wherein said product further comprises naphthalene, alkynaphthalenes comprising methylnaphthalenes and dimethylnaphthalenes.

7. The process in accordance with claim 1, wherein the hydrogenation/dehydrogenation component of said borosilicate molecular sieve comprises a Group VIIIA metal.

8. The process in accordance with claim 1, wherein the hydrogenation/dehydrogenation component of said borosilicate molecular sieve comprises platinum.

9. The process in accordance with claim 1, wherein, prior to said contacting, said heavy hydrocarbon feedstream is hydroprocessed to reduce S and N each to below about 100 ppm.

10. The process in accordance with claim 9, wherein, prior to said contacting, said heavy hydrocarbon feedstream is hydroprocessed to reduce S and N each to below about 10 ppm.

11. The process in accordance with claim 10, wherein, prior to said contacting, said heavy hydrocarbon feedstream is hydroprocessed to reduce S and N each to below about 1 ppm.

12. The process in accordance with claim 1, wherein said hydrogenation/dehydrogenation component of said borosilicate molecular sieve comprises a Group VIIIA metal and is optionally promoted by a component selected from the group consisting of a Group VIIA metal, a Group IIIB–VB metal, and mixtures thereof.

13. The process in accordance with claim 1, wherein said borosilicate molecular sieve further comprises a Group IA metal component, a Group IIA metal component, or mixtures thereof.

14. The process in accordance with claim 1, wherein said contacting step (a) is in a fixed, moving, or fluid bed reactor.

15. A catalytic hydrodealkylation/reforming process which comprises:

(a) contacting a heavy hydrocarbon feedstream having a major portion thereof boiling from about 350° F. to about 800° F. under catalytic hydrodealkylation/reforming conditions with a catalyst comprising a borosilicate molecular sieve selected from the group consisting of SSZ-24, SSZ-25, SSZ-31, SSZ-33, SSZ-35, SSZ-37, SSZ-42, SSZ-43, SSZ-44, SSZ-47, SSZ-48, CIT-5, UTD-1, low-aluminum boron-beta, and mixtures thereof, wherein said catalyst further comprises a Group VIIIA metal component, a promoter component selected from the group consisting of a Group VIIA metal, a Group IIIB–VB metal, and mixtures thereof, and a neutralizing component selected from the group consisting of a Group IA metal cation, a Group IIA metal cation, and mixtures thereof, wherein the molar ratio of said neutralizing component to boron is between about 0 and about 20;

(b) wherein at least a portion of said hydrocarbon feedstream is converted to a product selected from the group consisting of benzene, toluene, xylenes, ethylbenzene, naphthalene, methylnaphthalenes, dimethylnaphthalenes, and mixtures thereof; and (c) recovering a product stream comprising benzene, toluene, xylenes and ethylbenzene.

16. The process in accordance with claim 15, wherein said heavy hydrocarbon feedstream has a major portion thereof boiling from about 350° F. to about 600° F.

17. The process in accordance with claim 15, wherein said heavy hydrocarbon feedstream is selected from the group consisting of an FCC light cycle oil, a jet fuel, a Fisher-Tropsch product, a coker product, a coal liquefied oil, a product oil from the heavy oil thermal cracking process, a product oil from heavy oil hydrocracking, a straight run cut from a crude unit, and mixtures thereof.

18. The process in accordance with claim 15, wherein said borosilicate molecular sieve also contains a binder.

19. The process in accordance with claim 18, wherein said binder is selected from the group consisting of silica, alumina, magnesia, titania, vanadia, chromia, zirconia, and mixtures thereof.

20. The process in accordance with claim 15, wherein, prior to said contacting, said heavy hydrocarbon feedstream is hydroprocessed to reduce S and N each to below about 100 ppm.

21. The process in accordance with claim 20, wherein, prior to said contacting, said heavy hydrocarbon feedstream is hydroprocessed to reduce S and N each to below about 10 ppm.

22. The process in accordance with claim 21, wherein, prior to said contacting, said heavy hydrocarbon feedstream is hydroprocessed to reduce S and N each to below about 1 ppm.

23. The process in accordance with claim 15, wherein the amount of Group VIIIA metal component is between about 0.05 wt. % and about 10 wt. %.

24. The process in accordance with claim 23, wherein said Group VIIIA metal component is platinum.

25. The process in accordance with claim 15, wherein said Group VIIA metal component is rhenium.

26. The process in accordance with claim 15, wherein said Group IIIB–VB metal component is selected from the group consisting of gallium, indium, germanium, tin, lead, and mixtures thereof.

27. The process in accordance with claim 15, wherein said Group IA metal cation is selected from the group consisting of cesium, rubidium, potassium, sodium, lithium, and mixtures thereof.

28. The process in accordance with claim 15, wherein said Group IIA metal cation is selected from the group consisting of barium, strontium, calcium, magnesium, and mixtures thereof.

29. A catalytic hydrodealkylation/reforming process which comprises:

(a) contacting a hydrocarbon feedstream having a major portion thereof boiling from about 350° F. to about 600° F.; and being selected from the group consisting of an FCC effluent, a jet fuel, a Fisher-Tropsch product, a coker product, a coal liquefied oil, a product oil from the heavy oil thermal cracking process, a product oil from heavy oil hydrocracking, a straight run cut from a crude unit, and mixtures thereof, under catalytic hydrodealkylation reforming conditions, with a borosilicate molecular sieve selected from the group consisting of SSZ-24, SSZ-25, SSZ-31, SSZ-33, SSZ-35, SSZ-37, SSZ-42, SSZ-43, SSZ-44, SSZ-47, SSZ-48, CIT-5, UTD-1, low-aluminum boron-beta, and mixtures thereof, containing platinum and cesium, wherein the molar ratio of cesium to boron is between about 0 and about 4.0; wherein the amount of platinum is between about 0.05 wt. % and about 10 wt. %; and wherein prior to said contacting, said heavy hydrocarbon feedstream is hydroprocessed to reduce S and N each to below about 100 ppm;

(b) wherein at least a portion of said hydrocarbon feedstream is converted to a product comprising benzene, toluene, ethylbenzene, xylenes, naphthalene, methylnaphthalenes, and dimethylnaphthalenes; and (c) recovering a product stream comprising benzene, toluene, xylenes and ethylbenzene.

30. The process in accordance with claim 29, wherein, prior to said contacting, said hydrocarbon feedatream is hydroprocessed to reduce S and N each to below about 10 ppm.

31. The process in accordance with claim 30, wherein, prior to said contacting, said hydrocarbon feedstream is hydroprocessed to reduce S and N each to below about 1 ppm.

32. The process of claim 29, wherein said contacting in step (a) is at a temperature of from about 700° F. to about 1000° F.; a pressure of from about atmospheric to about 500 psig; a hydrocarbon feedstream WHSV of from about 0.1 $h^{-1}$ to about 15 $h^{-1}$; and a molar ratio of hydrogen to said hydrocarbon feedstream of from about 0.1 to about 100.

33. The process of claim 29, wherein at least a portion of any unconverted hydrocarbon feedstream from step (b) is recycled to said contacting step (a).

* * * * *